US009272533B2

(12) United States Patent
Asai et al.

(10) Patent No.: US 9,272,533 B2
(45) Date of Patent: Mar. 1, 2016

(54) IMAGE PROCESSING METHOD AND IMAGE PROCESSING APPARATUS

(71) Applicants: Toshiaki Asai, Shizuoka (JP); Kazutaka Yamamoto, Kanagawa (JP); Tomomi Ishimi, Shizuoka (JP); Yoshihiko Hotta, Shizuoka (JP)

(72) Inventors: Toshiaki Asai, Shizuoka (JP); Kazutaka Yamamoto, Kanagawa (JP); Tomomi Ishimi, Shizuoka (JP); Yoshihiko Hotta, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/402,455

(22) PCT Filed: May 17, 2013

(86) PCT No.: PCT/JP2013/064421

§ 371 (c)(1),
(2) Date: Nov. 20, 2014

(87) PCT Pub. No.: WO2013/176236

PCT Pub. Date: Nov. 28, 2013

(65) Prior Publication Data

US 2015/0151550 A1 Jun. 4, 2015

(30) Foreign Application Priority Data

May 23, 2012 (JP) ..... 2012-117678

(51) Int. Cl.

| | |
|---|---|
| ***B41J 2/435*** | (2006.01) |
| ***B41J 2/47*** | (2006.01) |
| ***B41J 2/44*** | (2006.01) |
| ***B41M 5/30*** | (2006.01) |

(Continued)

(52) U.S. Cl.

CPC .. *B41J 2/442* (2013.01); *B41J 2/32* (2013.01); *B41J 3/01* (2013.01); *B41M 5/305* (2013.01); *B41M 5/337* (2013.01); *B41M 5/46* (2013.01); *B41M 2205/04* (2013.01)

(58) Field of Classification Search

USPC ..... 347/224, 225, 236, 246, 253, 254, 262, 347/264

See application file for complete search history.

(56) References Cited

U.S. PATENT DOCUMENTS

| | | | |
|---|---|---|---|
| 6,121,574 | A | 9/2000 | Xu |
| 2007/0225162 | A1 | 9/2007 | Kawahara et al. |

(Continued)

FOREIGN PATENT DOCUMENTS

| | | | |
|---|---|---|---|
| EP | 1834795 | A1 | 9/2007 |
| EP | 1939003 | A1 | 7/2008 |

(Continued)

OTHER PUBLICATIONS

International Search Report issued Jul. 30, 2013 for counterpart International Patent Application No. PCT/JP2013/064421 filed May 17, 2013.

(Continued)

*Primary Examiner* — Hai C Pham
(74) *Attorney, Agent, or Firm* — Cooper & Dunham LLP

(57) ABSTRACT

To provide an image processing method, including: image recording, wherein an image composed of a plurality of laser drawn lines is recorded by heating by irradiating parallel laser lights on a recording medium spaced by a predetermined distance, wherein, in the image recording, among the plurality of laser drawn lines constituting the image, at least two units of lines drawn with different energy, each composed of a pair of laser drawn lines adjacent to each other and with different irradiation energy, are formed.

9 Claims, 8 Drawing Sheets

(51) Int. Cl.

| | |
|---|---|
| ***B41M 5/337*** | (2006.01) |
| ***B41M 5/46*** | (2006.01) |
| ***B41J 2/32*** | (2006.01) |
| ***B41J 3/01*** | (2006.01) |

(56) References Cited

U.S. PATENT DOCUMENTS

| | | | |
|---|---|---|---|
| 2011/0090299 | A1 | 4/2011 | Asai et al. |
| 2012/0200656 | A1 | 8/2012 | Oda |
| 2012/0212564 | A1 | 8/2012 | Yamamoto et al. |

FOREIGN PATENT DOCUMENTS

| | | | |
|---|---|---|---|
| EP | 2311642 | A1 | 4/2011 |
| JP | 07-179061 | | 7/1995 |
| JP | 09-030118 | | 2/1997 |
| JP | 11-151856 | | 6/1999 |
| JP | 2000-136022 | | 5/2000 |
| JP | 3557512 | | 5/2004 |
| JP | 2004-265247 | | 9/2004 |
| JP | 2004-265249 | | 9/2004 |
| JP | 2008-213439 | | 9/2008 |
| JP | 2011-056910 | | 3/2011 |
| JP | 2011-104994 | | 6/2011 |
| JP | 2011-116116 | | 6/2011 |
| JP | 2012-056134 | | 3/2012 |
| WO | WO2011/049147 | A1 | 4/2011 |
| WO | WO2011/049148 | A1 | 4/2011 |

OTHER PUBLICATIONS

European search report dated Jul. 2, 2015 in corresponding European Patent Application No. 13793654.8.

IMAGE PROCESSING METHOD AND IMAGE PROCESSING APPARATUS

TECHNICAL FIELD

The present invention relates to an image processing method and an image processing apparatus.

BACKGROUND ART

As a method for uniformly recording or erasing an image on a thermoreversible recording medium (hereinafter, it may also be referred to as a "recording medium" or a "medium") in case of surface irregularity on the medium or remote recording or erasing, various methods of making a laser light have been proposed (see PTL1 and so on). As such an image processing method by a laser light, a laser recording apparatus (laser marker) which enables to irradiate a high-power a laser light on the thermoreversible recording medium and control a location thereof has been provided. When the laser light is irradiated on the thermoreversible recording medium using this laser marker, a photothermal conversion material in the thermoreversible recording medium absorbs the light and converts it into heat, and image recording and image erasing can be carried out by the heat. For example, as a method for carrying out image recording and image erasing by a laser light, a method for recording by a near-infrared laser light, where a leuco dye, a reversible color developing agent, and various photothermal conversion materials are combined, has been proposed (see PTL2).

Here, examples of a method for scanning a laser light in image recording and image erasing using the laser light include those illustrated in FIG. 1 and FIG. 2. Here, in FIG. 1 and FIG. 2, solid arrows denote a laser drawing operation (marking operation), and dashed arrows denote a jump operation of moving drawing points (idling operation).

In FIG. 1, a first laser drawn line 201 is drawn from a first starting point to a first end point, and the laser light is irradiated and scanned so that a second laser drawn line 202 adjacent to the first laser drawn line 201 is drawn in parallel with the first laser drawn line 201 from a second starting point to a second end point.

According to the laser light scanning illustrated in FIG. 1, drawing in a short image recording time is possible with less speed reduction at a turnaround portion. However, due to a heat accumulation effect of printing the starting point of the second laser drawn line 202 right after printing the end point of the first laser drawn line 201, the thermoreversible recording medium is excessively heated at the turnaround portions of the laser drawn lines. As a result, there are problems of non-uniform image density and reduced repetition durability.

FIG. 2 illustrates a method for irradiating and scanning a laser light, where a first laser drawn line 211 is drawn from a first starting point to a first end point; the laser light is scanned without irradiating from the first end point to a second starting point; and a second laser drawn line 212 adjacent to the first laser drawn line 211 is drawn from the second starting point to a second end point in parallel with the first laser drawn line 211 (see PTL3).

According to this laser light scanning illustrated in FIG. 2, reduction of speed at a turnaround portion and an effect of heat accumulation may be improved, and an excess energy application on the thermoreversible recording medium may be avoided. Thereby, repetition durability improves. However, a dashed portion with no laser light irradiation is long, and thus an image recording time and an image erasing time are long. Also, in the laser light scanning method, as an alternative of reducing the heat accumulation effect, the second laser drawn line 212 is recorded in a cold state after the first laser drawn line 211 is drawn. Thus, heat accumulation cannot be used, and high energy is required. Thus, a scanning speed cannot be increased, and there is a problem that the image recording time cannot be reduced.

Also, the present applicants have proposed earlier a method for irradiating and scanning a laser light illustrated in FIG. 3 such that a first laser drawn line 221 is drawn from a first starting point to a first end point and then a second laser drawn line 222 adjacent to the first laser drawn line 221 is drawn from a second starting point toward a second end point located on a line in a direction tilted to the first starting point with respect to a line parallel to the first laser drawn line 221 (see PTL4).

According to this proposal illustrated in FIG. 3, uneven density at a solid image portion and an erased portion can be suppressed, and repetition durability of the solid image may be improved. At the same time, image printing and erasing times can be reduced. However, since the second laser drawn line 222 is diagonally recorded, there is a problem that an end portion of an image is missing depending on the types of the image.

Among images drawn by scanning a laser light, in case of drawing a bar code image in particular, a high image density and an accurate line width are required, it is necessary to draw the image by irradiating a high-energy laser light for improved readability. However, in all the methods for scanning a laser light described in the prior art, heat accumulation effect of a laser drawn line at a turnaround portion is not sufficiently resolved. Thus, it is at present difficult to draw an image with a high image density and an accurate line width and repeatedly draw an image with high readability when the image is a diagram of an arbitrary line width formed by a plurality of laser drawn lines, which requires a high image density and an accurate line width and requires improvement in readability, particularly a bar code image.

CITATION LIST

Patent Literature

PTL1 Japanese Patent Application Laid-Open (JP-A) No. 2000-136022
PTL2 JP-A No. 11-151856
PTL3 JP-A No. 2008-213439
PTL4A JP-A No. 2011-116116

SUMMARY OF INVENTION

Technical Problem

The present invention aims at providing an image processing method which enables an effective drawing with a high image density and an accurate line width and achieves an image with superior repetition durability even though the image is a diagram of an arbitrary line width formed by a plurality of laser drawn lines, which requires a high image density and an accurate line width and requires improvement in readability, particularly a bar code image.

Solution to Problem

An image processing method of the present invention as a means for solving the problems includes an image recording step, wherein an image composed a plurality of laser drawn lines is recorded by heating by irradiating parallel laser lights on a recording medium spaced by a predetermined distance, wherein, in the image recording step, among the plurality of laser drawn lines constituting the image, at least two units of lines drawn with different energy, each composed of a pair of laser drawn lines adjacent to each other and with different irradiation energy, are formed.

Advantageous Effects of Invention

According to the present invention, the conventional problems may be solved, the objects may be achieved, and it is possible to provide an image processing method which enables an effective drawing with a high image density and an accurate line width and achieves an image with superior repetition durability even though the image is a diagram of an arbitrary line width formed by a plurality of laser drawn lines, which requires a high image density and an accurate line width and requires improvement in readability, particularly a bar code image.

DESCRIPTION OF EMBODIMENTS

Figure 1:
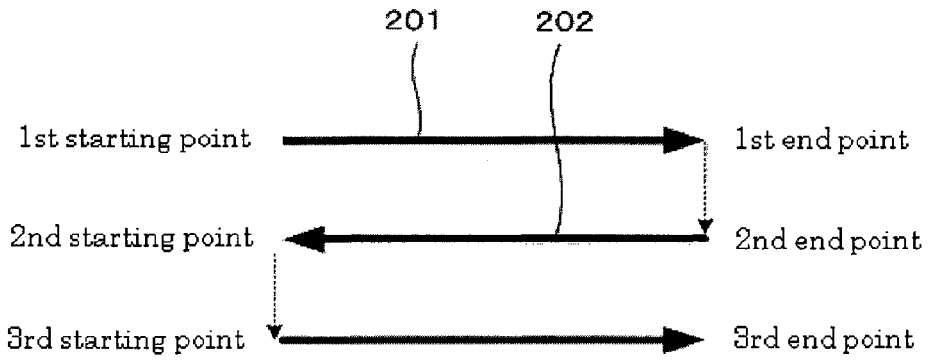
FIG. 1 is a schematic diagram illustrating one example of image recording by a conventional image processing method.

Image Processing Method and Image Processing Apparatus

An image processing method of the present invention includes an image recording step, and it further includes an image erasing step and other steps appropriately selected according to necessity.

An image processing apparatus of the present invention is used for the image processing method of the present invention. It includes a laser light emitting unit and a laser light scanning unit for scanning a laser light on a laser light irradiation surface of a recording medium, and it further includes other unite appropriately selected according to necessity.

Hereinafter, the image processing method and the image processing apparatus of the present invention are explained in detail.

<Image Recording Step>

The image recording step is a step for heating a recording medium by irradiating parallel laser lights spaced by a predetermined distance so as to record an image composed of a plurality of laser drawn lines.

Here, the image means, in general, a line diagram of an arbitrary line width formed of a plurality of laser drawn lines. Examples thereof include a two-dimensional code such as bar code and QR code (registered trademark) and a line constituting a fill, a graphic, a white and black reversed letter, a black-and-white reversed character, an outline character and a bold letter; the bar code is favorable. Examples of the bar code include ITF, CODE128, CODE39, JAN, EAN, UPC and NW-7.

The bar code is composed of narrow bars, wide bars, or a combination thereof, and a bar of the finest size is called as a narrow bar.

A height of the bar code is not particularly restricted, and it may be appropriately selected according to purpose. Nonetheless, it is preferably 3 mm to 40 mm, and more preferably 8 mm to 20 mm.

A length of the bar code is not particularly restricted, and it may be appropriately selected according to purpose. Nonetheless, it is preferably 5 mm to 150 mm.

A thickness (diameter) of one laser drawn line in drawing the bar code is not particularly restricted, and it may be appropriately selected according to purpose. Nonetheless, it is preferably 125 μm to 1,000 μm.

A spacing (pitch) as the shortest distance between centers of adjacent laser drawn lines in drawing the bar code is preferably 20% to 90% and more preferably 40% to 80% of the thickness (diameter) of one laser drawn line.

In the present invention, in the image recording step, (1) among a plurality of laser drawn lines constituting an image, at least two units of lines drawn with different energy are formed, each unit composed of a pair of laser drawn lines adjacent to each other and with different irradiation energy; preferably, (2) among a plurality of laser drawn lines constituting an image, laser drawn lines excluding a laser drawn line irradiated first have irradiation energy such that irradiation energy at a line end point is set to be incremented in a stepwise manner from irradiation energy at a line starting point. Thereby, a turnaround portion is not excessively heated. As a result, an image having no uneven density and having high image quality as well as superior repetition durability may be drawn. Thus, even a bar code image may be efficiently drawn with a high image density and an accurate line width.

In the image recording step, as described above, (1) among a plurality of laser drawn lines constituting an image, at least two units of lines drawn with different energy are formed, each unit composed of a pair of laser drawn lines adjacent to each other and with different irradiation energy. Thereby, irradiation energy of the entire image may be efficiently reduced. When the number of the unit of lines drawn with different energy is less than 2, the irradiation energy of the entire image becomes too high, and there are cases where repetition durability at a turnaround portion of the laser drawn lines decreases.

Among the plurality of laser drawn lines constituting an image, the number of units of lines drawn with different energy, each unit composed of a pair of laser drawn lines adjacent to each other and with different irradiation energy, varies depending on a number of laser drawn lines constituting the image and may not be unconditionally defined. Nonetheless, for example, it is preferably 2 when the number of the laser drawn lines constituting the image is 3. Also, the number of image the unit of lines drawn with different energy is preferably 2 to 4 when the number of the laser drawn lines constituting the image is 5. In addition, when the number of the laser drawn lines constituting the image is 8, the number of the unit of lines drawn with different energy is preferably 2 to 7, and more preferably 5 to 7. Furthermore, when the number of the laser drawn lines constituting the image is 10, the number of the unit of lines drawn with different energy is preferably 2 to 9, and more preferably 7 to 9.

Among the plurality of laser drawn lines constituting the image, a first unit of lines drawn with different energy is a combination of a first and a second laser drawn lines which are drawn first. The first line has irradiation energy preferably larger than the second line in view of efficient reduction of irradiation energy of the entire image.

Among the plurality of laser drawn lines constituting the image, at least two units of lines drawn with different energy are formed, each unit composed of a pair of laser drawn lines adjacent to each other and with different irradiation energy; in other words, among the plurality of laser drawn lines constituting the image, in order of laser light irradiation, even-numbered drawn lines have irradiation energy smaller than adjacent odd-numbered drawn lines. When locations of increasing or decreasing energy are consecutive, it is preferable that a laser drawn line with high energy and a laser drawn line with low energy are alternatively arranged.

Also, as described above, (2) among the plurality of laser drawn lines constituting the image, it is preferable that laser drawn lines excluding a laser drawn line irradiated first have irradiation energy such that irradiation energy at a line end point is set to be larger in a stepwise manner than irradiation energy at a line starting point. Thereby, uneven density and heat accumulation of the image may be fully eliminated.

Specifically, a segment between a line starting point and a line end point of each laser drawn line excluding the laser drawn line irradiated first is divided into a plurality of unit line segments, and irradiation energy is preferably incremented in a stepwise manner at each of the unit line segments from the line starting point toward the line end point. Thereby, excessive heating of turnaround portions of the laser drawn lines may be avoided, and an image having no uneven density and having high image quality and superior repetition durability may be drawn.

Figure 6:
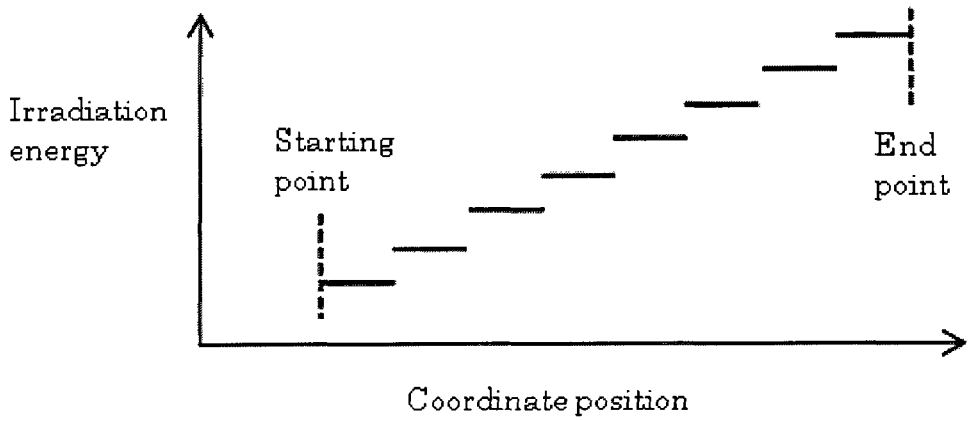
FIG. 6 is a diagram illustrating one example of a relationship between irradiation energy and a coordinate position.

For example, as illustrated in FIG. 6, a segment between a starting point and an end point of each laser drawn line excluding a laser drawn line irradiated first is divided into 8 unit line segments, and an image is drawn with irradiation energy incremented in a stepwise manner in 8 steps from the line starting point toward the line end point.

Figure 7:
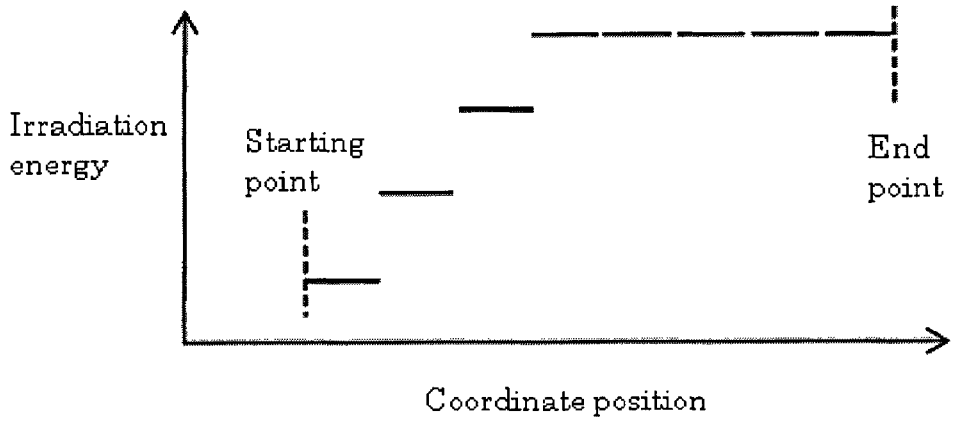
FIG. 7 is a diagram illustrating another example of a relationship between irradiation energy and a coordinate position.

Also, as illustrated in FIG. 7, a segment between a starting point and an end point of each laser drawn line excluding a laser drawn line irradiated first is divided into 8 unit line segments, and an image is drawn with irradiation energy incremented uniformly in 4 steps at the first 4 unit line segments from the starting point and with incremented and constant irradiation energy at the 4 steps in the last 4 unit line segments toward the end point.

Among the plurality of laser drawn lines constituting the image, the laser drawn line irradiated first preferably has irradiation energy with a uniform irradiation energy distribution and has the maximum irradiation energy. This is preferable in a case of simultaneously drawing an image composed of a single line since image density may be increased without adjusting separately irradiation energy of a laser drawn line, eliminating necessity for complex control.

Figure 4:
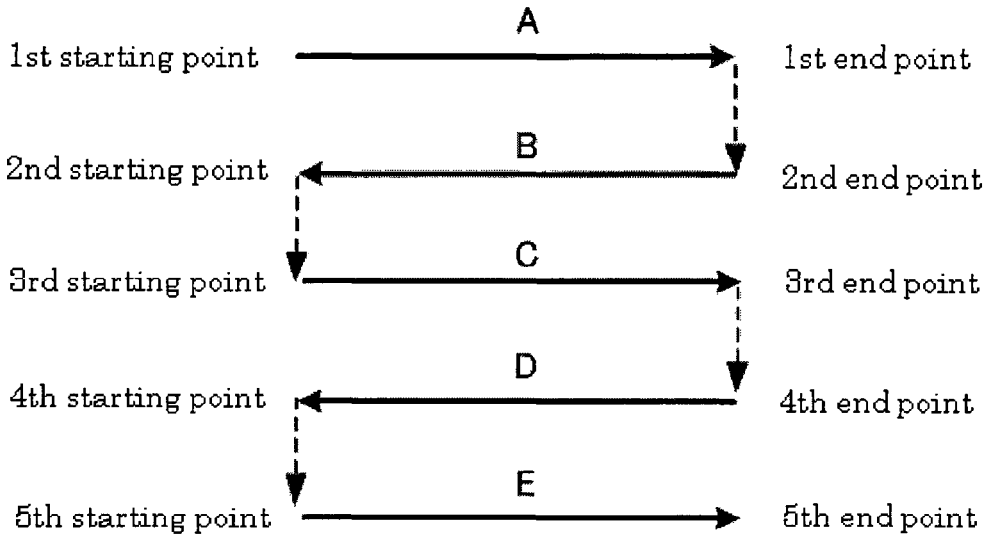
FIG. 4 is a schematic diagram illustrating one example of image recording by an image processing method of the present invention.

Here, for example, as illustrated in FIG. 4, an image is drawn with: irradiation energy for drawing a laser drawn line A larger than irradiation energy for drawing a laser drawn line B; irradiation energy for drawing a laser drawn line C larger than irradiation energy for drawing the laser drawn line B; irradiation energy for drawing a laser drawn line D smaller than irradiation energy for drawing the laser drawn line C; and finally irradiation energy for drawing a laser drawn line E larger than irradiation energy for drawing the laser drawn line D. Here, the drawing is carried out such that the irradiation energy at each line end point of the laser drawn lines B to E excluding the laser drawn line A drawn first is incremented in a stepwise manner from the irradiation energy at the respective line starting point. Thereby, the drawing is carried out by making efficient use of heat accumulation of the line drawn immediately before, and repetition durability may be improved while image quality is maintained.

Figure 5:
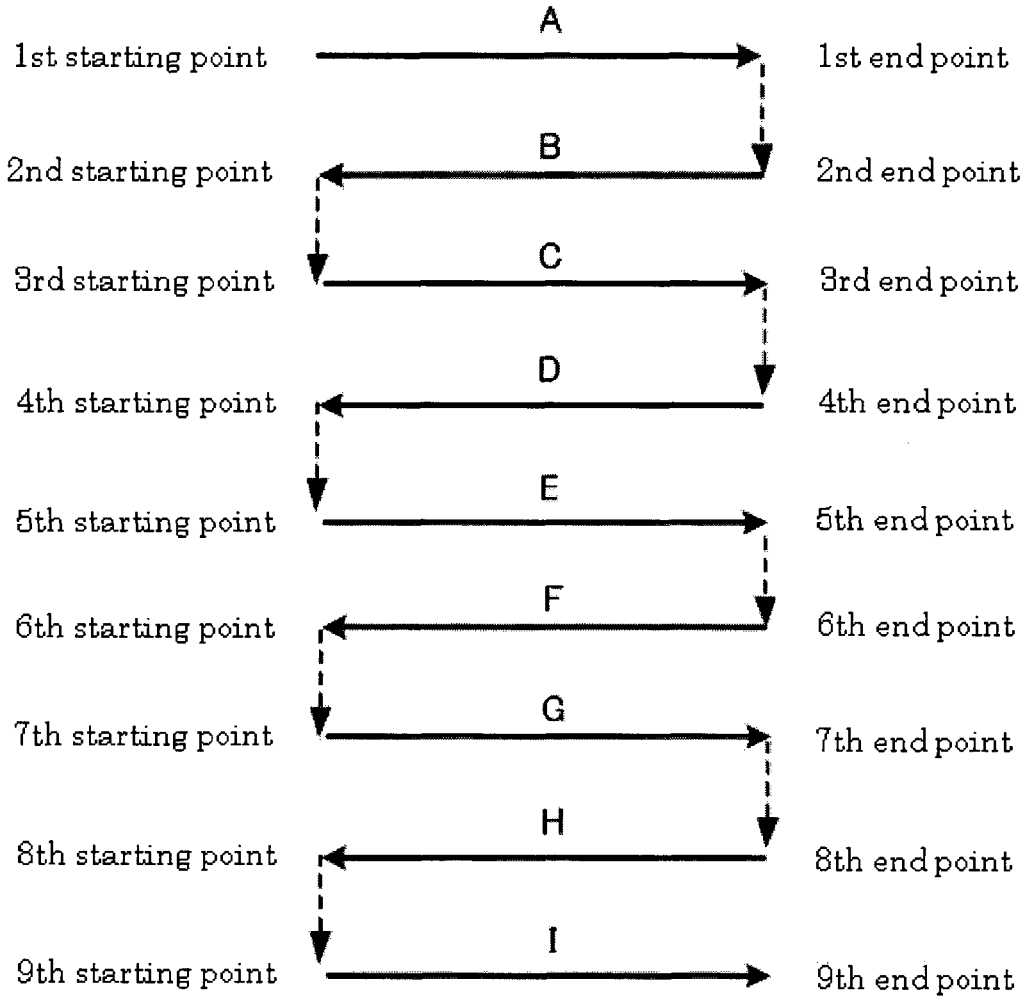
FIG. 5 is a schematic diagram illustrating another example of image recording by an image processing method of the present invention.

As illustrated in FIG. 5, in case of recording an image by scanning a laser light, the image is drawn by alternately increasing or decreasing irradiation energy of the laser light for each line only from laser drawn lines A to E similarly to FIG. 4 described above. Alternatively, to the contrary, the image may be drawn by alternatively increasing or decreasing irradiation energy of the laser light for each laser drawn line from laser drawn lines F to I similarly to FIG. 4.

Also, irradiation energy of the laser drawn lines other than those with their laser irradiation energy of the laser light alternately increased or decreased for each laser drawn line is preferably equivalent to that of the laser drawn line with the decreased irradiation energy. When it is set equivalent to the laser drawn line having the increased irradiation energy, there are cases where repetition durability degrades due to an effect of heat accumulation. Thereby, although there are cases where image quality degrades slightly within a range that does not significantly affect readability due to an effect of some of the lines with their irradiation energy of the laser light not alternatively increased or decreased, compared to the case where the irradiation energy of the laser light of all the lines are increased or decreased, it is possible to reduce locations where a residual image occurs, which is a concern of repeated printing and erasing.

A range of increasing or decreasing the irradiation energy is not particularly restricted, and it is not unambiguously determined since it is largely affected a laser light output, a scanning speed, a spot diameter, a spacing between laser lights in parallel for scanning, a waiting time from an end of drawing one laser drawn line until a beginning of drawing a next laser drawn line and so on. Nonetheless, as a lower limit of the range of increasing or decreasing the irradiation energy, a ratio ($Ee/E_0$) is preferably 80% or greater, more preferably 85% or greater, and further more preferably 88% or greater, provided that Ee is irradiation energy of an even-numbered laser drawn line and that $E_0$ is irradiation energy of an odd-numbered laser drawn line. On the other hand, as an upper limit of the range of increasing or decreasing the irradiation energy, a ratio ($Ee/E_0$) is preferably 99% or less, more preferably 95% or less, and further more preferably 92% or less.

When the ratio ($Ee/E_0$) is less than 80%, image density decreases. As a result, an image line width becomes narrow, and there are cases where image quality decreases. When it exceeds 99%, heat accumulation is not completely eliminated, and there are cases where repetition durability decreases.

In the present specification, the irradiation energy is defined as an irradiation energy density in irradiating a laser light in the image recording step, and it is defined separately from respective irradiation energy at a starting point and an end point of a laser drawn line and irradiation energy of a laser drawn line as a line segment.

The respective irradiation energy at a starting point and an end point of a laser drawn line is represented by: $P/(V*r)$, where P is an average power of the laser light at the starting point or the end point of the laser drawn line in the image recording step; V is an average scanning speedscanning speed of the laser light at the starting point or the end point of the laser drawn line in the image recording step; r is an average spot diameter on a recording medium in a vertical direction with respect to a scanning direction of the laser light in the image recording step.

Meanwhile, the irradiation energy of a laser drawn line as a line segment is expressed as: $P/(V*r)$, where P is an average power of a laser light from a starting point to an end point of the laser drawn line in the image recording step; V is an average scanning speedscanning speed of the laser light from the starting point to the end point of the laser drawn line in the image recording step; r is an average spot diameter on a recording medium in a vertical direction with respect to a scanning direction of the laser light in the image recording step.

The irradiation energy of a laser light is expressed in terms of a power P, a scanning speedscanning speed V and a spot diameter r of the laser light. Examples of methods for changing the irradiation energy of the laser light include changing only P, changing only V and changing only r, but it is not restricted thereto. These methods for changing the energy density may be used alone or in combination.

Among these, as the method for changing the irradiation energy of the laser light, irradiation energy per laser drawn line is changed preferably in terms of P, and irradiation energy at a starting point and a end point, respectively, of a laser drawn line is changed preferably in terms of V.

A method for controlling the scanning speed of the laser light is not particularly restricted, and it may be appropriately selected according to purpose. Examples thereof include a method of controlling a rotational speed of a motor responsible for an operation of a scanning mirror.

A method for controlling the irradiation power of the laser light is not particularly restricted, and it may be appropriately selected according to purpose. Examples thereof include a method of changing a setting of a light irradiation power and a control method by adjusting a pulse time width in case of a pulse laser.

Examples of the method for changing a setting of the light irradiation power include a method of changing the power setting depending on recording portions. As the control method by adjusting a pulse time width, irradiation energy may be adjusted by the irradiation power by varying a time width for pulse emission depending on recording portions.

The power of the laser light irradiated in the image recording step is not particularly restricted, and it may be appropriately selected according to purpose. Nonetheless, it is preferably 1 W or greater, more preferably 3 W or greater, and further more preferably 5 W or greater. When the power of the laser light is less than 1 W, it takes time for image recording, and trying to shorten the image recording time may result in insufficient power. Also, an upper limit of the power of the laser light is not particularly restricted, and it may be appropriately selected according to purpose. Nonetheless, it is preferably 200 W or less, more preferably 150 W or less, and further more preferably 100 W or less. The power of the laser light exceeding 200 W may lead to a larger-sized image processing apparatus (laser marker apparatus).

The scanning speed of the laser light irradiated in the image recording step is not particularly restricted, and it may be appropriately selected according to purpose. Nonetheless, it is preferably 300 mm/s or greater, more preferably 500 mm/s or greater, and further more preferably 700 mm/s or greater. When the scanning speed is less than 300 mm/s, it takes time for image recording. Also, an upper limit of the scanning speed of the laser light is not particularly restricted, and it may be appropriately selected according to purpose. Nonetheless, it is preferably 15,000 mm/s or less, more preferably 10,000 mm/s or less, and further more preferably 8,000 mm/s or less. The scanning speed exceeding 15,000 mm/s makes it difficult to control the scanning speed, and formation of a uniform image may become difficult.

The spot diameter of the laser light irradiated in the image recording step is not particularly restricted, and it may be appropriately selected according to purpose. Nonetheless, it is preferably 0.02 mm or greater, more preferably 0.1 mm or greater, and further more preferably 0.15 mm or greater. Also, an upper limit of the spot diameter of the laser light is not particularly restricted, and it may be appropriately selected according to purpose. Nonetheless, it is preferably 3.0 mm or less, more preferably 2.5 mm or less, and further more preferably 2.0 mm or less. When the spot diameter is less than 0.02 mm, the line width of an image becomes narrow, which may result in decreased visibility. Also, when the spot diameter exceeds 3.0 mm, the line width of the image is thick, and adjacent lines overlap. Thus, it becomes impossible to record a small-sized image.

A laser light emitting means of the laser may be appropriately selected according to purpose. Examples thereof include a laser diode, a YAG laser, a fiber laser and a $CO_2$ laser. Among these, the laser diode is particularly preferable because it has broad choices of wavelengths, providing more options of photothermal conversion materials, and also because the laser light source itself is small as the image processing apparatus, allowing reduction in size and price of the image processing apparatus. A wavelength of the laser diode, the YAG laser or the fiber laser light emitted from the laser light emitting unit may be appropriately selected from a range where it may be absorbed by a photothermal conversion material and it is preferably 700 nm or greater, more preferably 720 nm or greater, and particularly preferably 750 nm or greater. An upper limit of the laser light may be appropriately selected according to purpose. Nonetheless, it is preferably 1,500 nm or less, more preferably 1,300 mm or less, and particularly preferably 1,200 nm or less.

The wavelength of less than 700 nm causes problems in a visible light region such as decreased contrast of the recording medium during image recording and coloration of the recording medium. There is also a problem that degradation of the recording medium occurs more likely in an ultraviolet light region of a shorter wavelength.

Also, the photothermal conversion material added to the recording medium requires a high decomposition temperature in order to ensure durability against repeated image processing. It is difficult to obtain a photothermal conversion material having a high decomposition temperature and a long absorption wavelength when an organic dye is used for the photothermal conversion material. Thus, the wavelength of the laser light is preferably 1,500 nm or less.

The wavelength of the laser light emitted from the COs laser is 10.6 μm, which is in a far-infrared region, and the medium absorbs the laser light at a surface thereof without addition of an additive for absorbing the laser light and generating heat. Also, there are cases where the additive absorbs, albeit slightly, a visible light even when the laser light having a wavelength in a far-infrared region is used. Thus, the $CO_2$ laser, which does not require the additive, is advantageous in view of preventing decrease in image contrast.

<Image Erasing Step>

The image recording on a thermoreversible recording medium as a recording medium includes a step for erasing an image recorded on the thermoreversible recording medium by heating the thermoreversible recording medium on which the image has been formed.

The image erasing step includes, for example, a width-direction collimating step, a length-direction light-distribution controlling step, a beam-size adjusting step and so on, and they are carried out by a width-direction collimating unit, a length-direction light-distribution controlling unit, a beam-size adjusting unit and so on.

Examples of a method for heating the thermoreversible recording medium include conventionally heretofore known heating methods (e.g., non-contact heating methods such as laser light irradiation, hot air, hot water and infrared heater, contact heating methods such as thermal head, hot stamping, heat block and heat roller). When a distribution line is assumed, a method of heating a thermoreversible recording medium by irradiating a laser light is particularly preferable since it allows erasing of an image in a non-contact manner.

A power of the laser light irradiated in the image erasing step, where the thermoreversible recording medium is heated by irradiating a laser light with a circular beam to erase an image, is not particularly restricted, and it may be appropriately selected according to purpose. Nonetheless, it is preferably 5 W or greater, more preferably 7 W or greater, and further more preferably 10 W or greater. When the power of the laser light is less than 5 W, it takes time for image erasing, and trying to shorten the image erasing time results in insufficient power and causes poor image erasing. Also, an upper limit of the power of the laser light is not particularly restricted, and it may be appropriately selected according to purpose. Nonetheless, it is preferably 200 W or less, more preferably 150 W or less, and further more preferably 100 W or less. The power of the laser light exceeding 200 W may result in an increase in size of a laser device.

A scanning speed of the laser light irradiated in the image erasing step, where the thermoreversible recording medium is heated by irradiating a laser light with a circular beam to erase an image, is not particularly restricted, and it may be appropriately selected according to purpose. Nonetheless, it is preferably 100 mm/s or greater, more preferably 200 mm/s or greater, and further more preferably 300 mm/s or greater. When the scanning speed is less than 100 mm/s, it takes time for image erasing. Also, an upper limit of the scanning speed of the laser light is not particularly restricted, and it may be appropriately selected according to purpose. Nonetheless, it is preferably 20,000 mm/s or less, more preferably 15,000 mm/s or less, and further more preferably 10,000 mm/s or less. When the scanning speed exceeds 20,000 mm/s, there are cases where uniform image erasing becomes difficult.

A spot diameter of the laser light irradiated in the image erasing step, where the thermoreversible recording medium is heated by irradiating a laser light with a circular beam to erase an image, is not particularly restricted, and it may be appropriately selected according to purpose. Nonetheless, it is preferably 0.5 mm or greater, more preferably 1.0 mm or greater, and further more preferably 2.0 mm or greater. Also, an upper limit of the spot diameter of the laser light is not particularly restricted, and it may be appropriately selected according to purpose. Nonetheless, it is preferably 14.0 mm or less, more preferably 10.0 mm or less, and further more preferably 7.0 mm or less.

When the spot diameter is less than 0.5 mm, there are cases where it takes time for image erasing. Also, the spot diameter exceeding 14.0 mm may result in poor image erasing due to insufficient power.

A laser light emitting unit used in the image erasing step may be appropriately selected according to purpose. Examples thereof include a laser diode array, a YAG laser, a fiber laser and a $CO_2$ laser. Among these, the laser diode array is particularly preferable because it provides wide wavelength selectivity and enables reduction in apparatus size and price due to the small laser light source as a laser apparatus.

—Laser Diode Array—

The laser diode array is a laser diode light source including a plurality of linearly arranged laser diodes. It includes preferably 3 to 300, more preferably 10 to 100 laser diodes.

When the number of the laser diode is small, there are cases where irradiation power cannot be increased. When it is in excess, there are cases where a large cooling device for cooling the laser diode array is required. Here, the laser diode is heated for emitting the laser diode array, and it requires cooling. As a result, an equipment cost may increase.

A light source length of the laser diode array is not particularly restricted, and it may be appropriately selected according to purpose. Nonetheless, it is preferably 1 mm to 50 mm, and more preferably 3 mm to 15 mm. When the light source length of the laser diode array is less than 1 mm, the irradiation power cannot be increased. When it exceeds 30 mm, a large cooling apparatus is required for cooling the laser diode array, and an equipment cost may increase.

A wavelength of the laser light of the laser diode array is not particularly restricted, and it may be appropriately selected according to purpose. Nonetheless, it is preferably 700 nm or greater, more preferably 720 nm or greater, and further more preferably 750 nm or greater. An upper limit of the wavelength of the laser light may be appropriately selected according to purpose. Nonetheless, it is preferably 1,500 nm or less, more preferably 1,300 mm or less, and further more preferably 1,200 nm or less.

When the wavelength of the laser light is set to a wavelength shorter than 700 nm, there are problems in a visible light region that the contrast of the thermoreversible recording medium decreases during image recording and that the thermoreversible recording medium is colored. In an ultraviolet light region with a further shorter wavelength, there is a problem that degradation of the thermoreversible recording medium is likely to occur. Also, the photothermal conversion material added to the thermoreversible recording medium is required to have a high decomposition temperature in order to ensure durability against repetitive image processing. It is difficult to obtain a photothermal conversion material having a high decomposition temperature and a long absorption wavelength when an organic dye is used for the photothermal conversion material. Accordingly, the wavelength of the laser light is preferably 1,500 nm or less.

—Width-Direction Collimating Step—

The width-direction collimating step is a step for forming a line-shaped beam by collimating laser lights spreading in a width direction irradiated from a laser diode array having a plurality of linearly arranged laser diodes, and it may be carried out by a width-direction collimating unit.

The width-direction collimating unit is not particularly restricted, and it may be appropriately selected according to purpose. Examples thereof include one single-sided convex cylindrical lens and a combination of a plurality of convex cylindrical lenses.

The laser lights of the laser diode array has a diffusion angle in the width direction larger compared to the length direction. Thus, the width-direction collimating unit arranged close to an irradiation surface of the laser diode array is preferable since it can avoid broadening the beam width and thus reduce the lens size.

—Length-Direction Light-Distribution Controlling Step—

The length-direction light-distribution controlling step is a step for making a length of the line-shaped beam formed in the width-direction collimating step longer than a light source length of the laser diode array as well as making a light distribution thereof uniform in a length direction, and it may be carried out by a length-direction light-distribution controlling unit.

The length-direction light-distribution controlling unit is not particularly restricted, and it may be appropriately selected according to purpose. For example, it can be implemented by a combination of two spherical lenses, aspherical cylindrical lenses (length direction) or cylindrical lenses (width direction). Examples of the aspherical cylindrical lens (length direction) include a fresnel lens, a convex lens array and a concave lens array.

The length-direction light-distribution controlling unit is arranged on a side of an irradiating surface of the collimating unit.

—Beam-Size Adjusting Step—

The beam-size adjusting step is a step for adjusting at least any one of a length and a width on a thermoreversible recording medium of the line-shaped beam which is longer than the light source length than the laser diode array and which has a uniform light distribution in the length direction, and it may be carried out by a beam-size adjusting unit.

The beam-size adjusting unit is not particularly restricted, and it may be appropriately selected according to purpose. Examples thereof include: changing a focal length of a cylindrical lens or a spherical lens; changing a lens installation position; and changing a work distance between the apparatus and the thermoreversible recording medium.

The length of the line-shaped beam after adjustment is not particularly restricted, and it may be appropriately selected according to purpose. Nonetheless, it is preferably 10 mm to 300 mm, and more preferably 30 mm to 160 mm. The beam length determines an erasable area. Thus, the short beam length reduces the erasure area, and the long beam length results in addition of energy to an area which needs no erasure. These may cause energy loss and damages.

The beam length is preferably twice, more preferably 3 times as long as the light source length of the laser diode array. When the beam length is shorter than the light source length of the laser diode array, it becomes necessary to increase the length of the light source of the laser diode array in order to ensure a long erasure area, which may result in increased apparatus cost and apparatus size.

Also, the width of the line-shaped beam after adjustment is not particularly restricted, and it may be appropriately selected according to purpose. Nonetheless, it is preferably 0.1 mm to 10 mm, and more preferably 0.2 mm to 5 mm. The beam width can control a heating time of the thermoreversible recording medium. When the beam width is narrow, the short heating time reduces erasability. When the beam width is wide, the long heating time results in application of excess energy on the thermoreversible recording medium, which requires high energy, and erasure at high speed is not possible. It is necessary to adjust the equipment so that it has a beam width appropriate for erasing characteristics of the thermoreversible recording medium.

A power of the thus-adjusted line-shaped beam is not particularly restricted, and it may be appropriately selected according to purpose. Nonetheless, it is preferably 10 W or greater, more preferably 20 W or greater, and further more preferably 40 W or greater. When the power of the laser light is less than 10 W, it takes time for image erasing, and trying to shorten the image erasing time results in insufficient power and causes poor image erasing. Also, an upper limit of the power of the laser light is not particularly restricted, and it may be appropriately selected according to purpose. Nonetheless, it is preferably 500 W or less, more preferably 200 W or less, and further more preferably 120 W or less. The power of the laser light exceeding 500 W may result in an increase in size of a cooling device of the light source of the laser diodes.

<Other Steps and Other Units>

Examples of the other steps include a scanning step and a controlling step. Examples of the other units include a scanning unit and a controlling unit.

—Scanning Step and Scanning Unit—

The scanning step is a step for scanning a line-shaped beam, which is longer than the light source length of the laser diode array and has a uniform light distribution in a length direction, on the recording medium in an axial direction, and it may be carried out by the scanning unit.

The scanning unit is not particularly restricted as long as the line-shaped beam may be scanned in an axial direction, and it may be appropriately selected according to purpose. Examples thereof include a uniaxial galvano mirror, a polygon mirror and a stepping motor mirror.

With the uniaxial galvano mirror and the stepping motor mirror, it is possible to finely control speed adjustment. Speed control is difficult with the polygon mirror, but it is a low price.

A scanning speed of the line-shaped beam is not particularly restricted, and it may be appropriately selected according to purpose. Nonetheless, it is preferably 2 mm/s or greater, more preferably 10 mm/s or greater, and further more preferably 20 mm/s or greater. When the scanning speed is less than 2 mm/s, it takes time for image erasing. Also, an upper limit of the scanning speed of the laser light is not particularly restricted, and it may be appropriately selected according to purpose. Nonetheless, it is preferably 1,000 mm/s or less, more preferably 300 mm/s or less, and further more preferably 100 mm/s or less. When the scanning speed exceeds 1,000 mm/s, there are cases where uniform image erasing is difficult.

Also, it is preferable to erase an image which has been recorded on the recording medium by conveying the recording medium by a conveying unit with respect to the line-shaped beam which is longer than the light source length of the laser diode array and has a uniform light distribution in a length direction and by scanning the line-shaped beam on the recording medium. Examples of the conveying unit include a conveyer and a stage. In this case, it is preferable that the recording medium is attached to a surface of a box and that the recording medium is conveyed by conveying the box by a conveyer.

—Control Step and Control Unit—

The control step is a step for controlling the steps, and it may be favorably carried out by a control unit.

The control unit is not particularly restricted as long as it can control operations of each of the units, and it may be appropriately selected according to purpose. Examples thereof include devices such as sequencer and computer.

Figure 10:
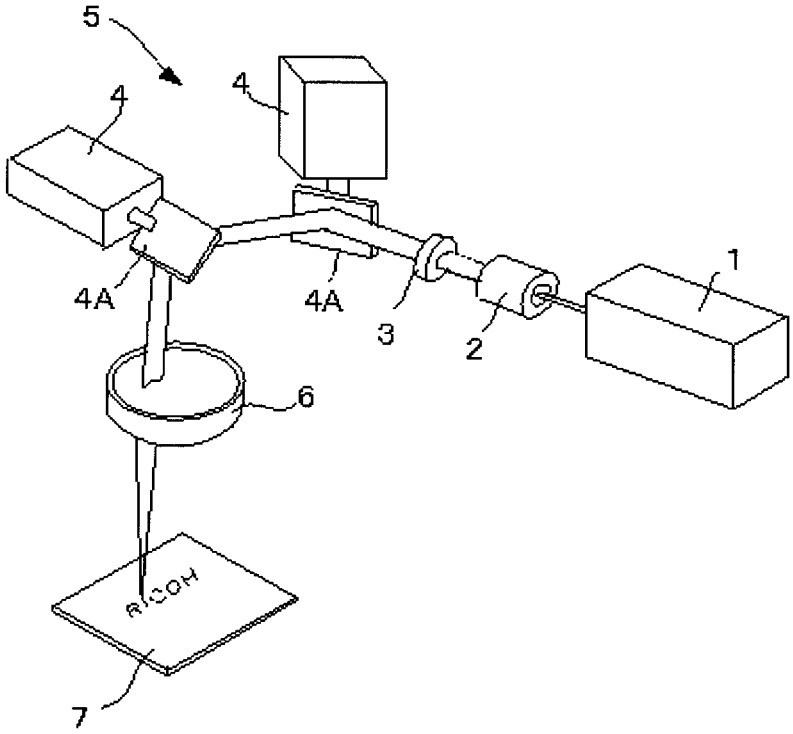
FIG. 10 is a schematic diagram illustrating one example of an image processing apparatus of the present invention.

Here, one example of the image processing apparatus of the present invention is explained in reference to FIG. 10. This image processing apparatus includes a laser irradiating unit, a power supply controlling unit and a program unit.

The laser irradiating unit is composed of a laser oscillator 1, a beam expander 2, a scanning unit 5 and so on. In FIG. 10, the reference sign 6 denotes an fθ lens.

The laser oscillator 1 is mandatory for obtaining a laser light having high light intensity and high directivity. For example, mirrors are arranged on both sides of a laser medium, and the laser medium is pumped (supplied with energy). This increases the number of atoms in an excited state, forming a population inversion to cause a stimulated emission. Thereafter, only the light in an optical axis direction is selectively amplified, which enhances directivity of the light, and the laser light is emitted from an output mirror.

The scanning unit 5 is composed of a galvanometer 4 and a mirror 4A attached to the galvanometer 4. The laser light emitted from the laser oscillator 1 is subjected to high-speed scanning by two mirrors 4A in the x-axis and y-axis directions attached to the galvanometer 4, and thereby, image recording or erasing is carried out on a thermoreversible recording medium 7.

The power supply controlling unit is composed of a drive power supply of a light source which excites the laser medium; a drive power supply of the galvanometer; a cooling power supply such as Peltier element; and a control unit for controlling the entire image processing apparatus.

The program unit is a unit for entering conditions such as laser light intensity and laser scanning speed for image recording or erasing and for creating and editing letters and so on to be recorded by means of touch panel input or keyboard input.

Here, the laser irradiating unit, i.e., a head portion for image recording/erasing, is mounted on the image processing apparatus, and other than this, the image processing apparatus includes a conveying unit of the thermoreversible recording medium, a control unit thereof and a monitoring unit (touch panel).

<Recording Medium>

The image processing method is not particularly restricted, and it may be appropriately selected according to purpose. For example, it may be used as an image processing method on an irreversible recording medium. However, it is preferably an image processing method for carrying out image recording and image erasing on a reversible thermoreversible recording medium.

It is preferable to select the wavelength of the laser light to be emitted such that the recording medium absorbs the laser light with high efficiency. For example, a thermoreversible recording medium used in the present invention includes a photothermal conversion material, which has a role of absorbing the laser light with high efficiency and generating heat. Thus, it is preferable to select the wavelength of the laser light to be emitted such that the photothermal conversion material to be included absorbs the laser light with the highest efficiency compared to other materials.

<<Thermoreversible Recording Medium>>

The thermoreversible recording medium preferably includes a substrate and a thermoreversible recording layer including a photothermal conversion material on the substrate, and it further includes other layers such as first oxygen barrier layer, second oxygen barrier layer, ultraviolet absorbing layer, back layer, protective layer, intermediate layer, undercoat layer, adhesive layer, tacky layer, colored layer, air layer and light reflecting layer appropriately selected according to necessity. These layers may have a single-layer structure or a laminated structure. However, a layer disposed on the photothermal conversion layer is preferably composed of a material having low absorption at a specific wavelength in order to reduce energy loss of the laser light to be irradiated at the specific wavelength.

—Substrate—

A shape, a structure and a size of the substrate are not particularly restricted, and they may be appropriately selected according to purpose. Examples of the shape include a flat plate. As the structure, it may have a single-layer structure or a laminated structure. The size may be appropriately selected depending on a size of the thermoreversible recording medium.

Examples of a material of the substrate include an inorganic material and an organic material.

Examples of the inorganic material include glass, quartz, silicon, silicon oxide, aluminum oxide, $SiO_2$ and metals.

Examples of the organic material include paper, cellulose derivatives such as cellulose triacetate, synthetic paper and films of polyethylene terephthalate, polycarbonate, polystyrene and polymethyl methacrylate.

The inorganic material and the organic material may be used alone or in combination of two or more. Among these, the organic material is preferable. Films of polyethylene terephthalate, polycarbonate or polymethyl methacrylate are preferable, and polyethylene terephthalate is particularly preferable.

The substrate is preferably subjected to surface modification by a corona discharge treatment, an oxidation reaction treatment (chromic acid, etc.), an etching treatment, an easy adhesion treatment, an antistatic treatment and so on for the purpose of improving adhesion of a coating layer.

It is preferable to add a white pigment such as titanium oxide to the substrate to make the substrate white.

An average thickness of the substrate is not particularly restricted, and it may be appropriately selected according to purpose. Nonetheless, it is preferably 10 μm to 2,000 μm, and more preferably 50 μm to 1,000 μm.

—Thermoreversible Recording Layer—

The thermoreversible recording layer in any case includes a leuco dye as a electron-donating color forming compound and a color developer as a electron-accepting compound. It is a thermoreversible recording layer whose color tone changes reversibly by heat. It includes binder resin and other components according to necessity.

The thermoreversible recording layer may be a single-layer structure or a multi-layer structure of a first thermoreversible recording layer and a second thermoreversible recording layer.

The leuco dye as an electron-donating color forming compound whose color tone changes reversibly by heat and the reversible color developing agent as an electron-accepting compound are materials capable of expressing a phenomenon of a visible change which occurs reversibly by a temperature change. They are capable of changing between a relatively colored state and a discolored state by a difference between a heating speed and a cooling speed after heating.

—Leuco Dye—

The leuco dye itself is a colorless or slightly colored dye precursor. The leuco dye is not particularly restricted, and it may be appropriately selected from heretofore known ones, and examples thereof include leuco compounds of triphenylmethane phthalide, triallylmethane, fluoran, phenothiazine, thiofluoran, xanthene, indophthalyl, spiropyran, azaphthalide, chromenopyrazol, methine, rhodamine anilinolactam, rhodamine lactam, quinazoline, diazaxanthene and bislactone. Among these, the phthalide leuco dyes such as fluoran, triphenylmethane phthalide and azaphthalide are particularly preferable in view of their superior coloring and decoloring properties, color and preservability. These may be used alone or in combination of two or more. By laminating layers which color in various color tones, a multi-color or a full-color medium is possible.

—Reversible Color Developing Agent—

The reversible color developing agent is not particularly restricted as long as it carries out reversible coloring and decoloring by heat, and it may be appropriately selected according to purpose. Favorable examples thereof include compounds including one or more structures selected from: (1) a structure having a color developing property to color the leuco dye (e.g., phenolic hydroxyl group, carboxylic acid group, phosphoric acid group and so on), and, (2) a structure controlling cohesive forces among molecules (e.g., structure in which long-chain hydrocarbon groups are linked). Here, a linking portion may be via a linking group having 2 or more valences including a heteroatom, and the long-chain hydrocarbon group may include the similar linking group or an aromatic group, or both thereof.

As (1) the structure having a color developing property to color the leuco dye, a phenol is particularly preferable.

As (2) the structure controlling cohesive forces among molecules, a long-chain hydrocarbon group having 8 or more carbon atoms is preferable. The number of carbon atoms is preferably 11 or greater, and an upper limit of the number of carbon atoms is preferably 40 or less, and more preferably 30 or less.

Among the reversible color developing agents, a phenol compound represented by General Formula (1) below is preferable, and a phenol compound represented by General Formula (2) below is more preferable.

General Formula (1)

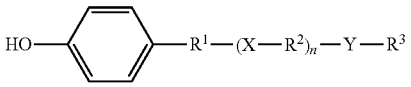

General Formula (2)

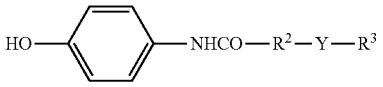

Here, in General Formulae (1) and (2), $R^1$ represents a single bond or an aliphatic hydrocarbon group having 1 to 24 carbon atoms. $R^2$ represents an aliphatic hydrocarbon group having 2 or more carbon atoms, which may have one or more substituents, and the number of carbon atoms is preferably 5 or greater, and more preferably 10 or greater. $R^3$ represents an aliphatic hydrocarbon group having 1 to 35 carbon atoms, and the number of carbon atoms is preferably 6 to 35, and more preferably 8 to 35. These aliphatic hydrocarbon groups may be used alone or in combination of two or more.

A sum of the number of carbon atoms in $R^1$, $R^2$ and $R^3$ above is not particularly restricted, and it may be appropriately selected according to purpose. Nonetheless, as a lower limit, it is preferably 8 or greater, and more preferably 11 or greater. As an upper limit, it is preferably 40 or less, and more preferably 35 or less.

When the sum of the number of carbon atoms is less than 8, there are cases where coloring stability and decoloring property degrade.

The aliphatic hydrocarbon group may be linear or branched, or it may include an unsaturated bond, but it is preferably linear. Also, examples of the substituent bonded to the hydrocarbon group include a hydroxyl group, a halogen atom and an alkoxy group.

X and Y are respectively identical or different, each representing a divalent group including an N atom or an O atom. Specific examples thereof include an oxygen atom, an amide group, an urea group, a diacylhydrazine group, an oxalic acid diamide group and an acylurea group. Among these, the amide group and the urea group are preferable.

Also, n represents an integer of 0 or 1.

With the electron-accepting compound (color developer), it is preferable to use a compound having at least one —NHCO— group or —OCONH— group in the molecule as a decoloring accelerator. Thereby, an intermolecular interaction is induced between the color developer and the decoloring accelerator in a process of forming a decolored state, and coloring and decoloring properties improve.

The decoloring accelerator is not particularly restricted, and it may be appropriately selected according to purpose.

The thermoreversible recording layer may include a binder resin, and it may further include additives according to necessity for improving and controlling coating property and coloring and decoloring properties of the thermoreversible recording layer. Examples of the additive include a surfactant, a conductive agent, a filler, an antioxidant, a light stabilizer, a coloring stabilizer and a decoloring accelerator.

—Binder Resin—

The binder resin is not particularly restricted, and it may be appropriately selected according to purpose. One type or two or more types of resins from conventionally heretofore known resins may be mixed and used. Among these, resins which may be curable by heat, ultraviolet light or electron beam are favorably used in order to improve repetition durability, and a thermosetting resin which uses an isocyanate compound as a crosslinking agent is particularly preferable.

Examples of the thermosetting resin include a resin containing a group reactive with a crosslinking agent such as hydroxyl group and carboxyl group and a resin that a monomer containing a hydroxyl group or a carboxyl group and another monomer are copolymerized. Examples of the thermosetting resin include a phenoxy resin, a polyvinyl butyral resin, a cellulose acetate propionate resin, a cellulose acetate butyrate resin, an acrylic polyol resin, a polyester polyol resin and a polyurethane polyol resin. Among these, the acrylic polyol resin, the polyester polyol resin and the polyurethane polyol resin are particularly preferable.

A mixing ratio (mass ratio) of the leuco dye and the binder resin in the thermoreversible recording layer is not particularly restricted, and it may be appropriately selected according to purpose. Nonetheless, it is preferably 0.1 to 10 with respect to the leuco dye of 1. When the amount of the binder resin is too small, heat intensity of the thermoreversible recording layer may be insufficient. When the amount of the binder resin is in excess, there are cases where a problem occurs due to decreased color density.

The crosslinking agent is not particularly restricted, and it may be appropriately selected according to purpose. Examples thereof include isocyanates, amino resins, phenolic resins, amines and epoxy compounds. Among these, the isocyanates are preferable, and polyisocyanate compounds containing a plurality of isocyanate groups are particularly preferable.

An amount of the crosslinking agent added with respect to the binder resin is preferably such that a ratio of the number of functional groups in the crosslinking agent to the number of active groups included in the binder resin is 0.01 to 2. The ratio of less than 0.01 may result in insufficient heat intensity. The ratio exceeding 2 may adversely affect the coloring and decoloring properties.

Further, a catalyst for this type of reaction may be used as a crosslinking accelerator.

A gel fraction of the thermosetting resin in case of thermal crosslinking is not particularly restricted, and it may be appropriately selected according to purpose. Nonetheless, it is preferably 30% or greater, more preferably 50% or greater, and further more preferably 70% or greater. When the gel fraction is less than 30%, there are cases where durability is inferior due to insufficient crosslinking state.

As a method to distinguish whether the binder resin is in a crosslinking state or a non-crosslinking state, for example, it may be distinguished by dipping the coating film in a solvent having a high solubility. That is, when the binder resin is in a non-crosslinking state, the resin dissolves in the solvent and does not remain in the solute.

The other components in the thermoreversible recording layer are not particularly restricted, and they may be appropriately selected according to purpose. Examples thereof include a surfactant and a plasticizer in view of facilitating image recording.

For a coating solution of thermoreversible recording layer, heretofore known methods may be used for the solvent, a dispersion apparatus of the coating solution, a coating method, a drying and curing method and so on.

Here, the thermoreversible recording layer coating solution may be prepared by dispersing the materials in the solvent using the dispersion apparatus or by dispersing each of the materials separately in the solvent and mixing them later. Further, the materials may be dissolved by heating followed by precipitation by rapid or slow cooling.

A method for forming the thermoreversible recording layer is not particularly restricted, and it may be appropriately selected according to purpose. Examples thereof include: (1) a thermoreversible recording layer coating solution including the resin, the leuco dye and the reversible color developing agent dissolved or dispersed in a solvent is applied on a substrate, then the solvent is evaporated to make the coating into a sheet at the same time as or followed by crosslinking; (2) a thermoreversible recording layer coating solution including the leuco dye and the reversible color developing agent dispersed in a solvent in which only the resin is dissolved is applied on a substrate, then the solvent is evaporated to make the coating into a sheet at the same time as or followed by crosslinking; and (3) without using a solvent, the resin, the leuco dye and the reversible color developing agent are mixed together by heat melting, and this melt mixture is formed into a sheet followed by cooling and then crosslinking. Here, in these methods, it is possible to form a thermoreversible recording medium as a sheet without using the substrate.

The solvent used in (1) or (2) varies depending on types of the resin, the leuco dye and the reversible color developing agent, and it cannot be unambiguously determined. Nonetheless, examples thereof include tetrahydrofuran, methyl ethyl ketone, methyl isobutyl ketone, chloroform, carbon tetrachloride, ethanol toluene and benzene.

Here, the reversible color developing agent is distributed in the thermoreversible recording layer in a form of particles.

To the thermoreversible recording layer coating solution, for example, a pigment, a defoamer, a dispersant, a slip agent, a preservative, a crosslinking agent and a plasticizer of various types may be added.

The thermoreversible recording layer is not particularly restricted, and it may be appropriately selected according to purpose. For example, it may be formed by conveying a substrate continuous in a roll or cut into a sheet and by applying the thermoreversible recording layer coating solution on the substrate, followed by drying.

The coating method is not particularly restricted, and it may be appropriately selected according to purpose. Examples thereof include blade coating, wire bar coating, spray coating, air knife coating, bead coating, curtain coating, gravure coating, kiss coating, reverse roll coating, dip coating and die coating.

A drying condition of the thermoreversible recording layer coating solution is not particularly restricted, and it may be appropriately selected according to purpose. For example, it is at a temperature from a room temperature (25° C.) to 140° C. for around 10 seconds to 10 minutes.

An average thickness of the thermoreversible recording layer is not particularly restricted, and it may be appropriately selected according to purpose. For example, it is preferably 1 μm to 20 μm, and more preferably 3 μm to 15 μm. When the average thickness of the thermoreversible recording layer is too small, image contrast may decrease due to low color density. On the other hand, when the average thickness of the thermoreversible recording layer is too large, heat distribution within the layer increases, and some portions do not reach the coloring temperature. They do not develop color, and desired color density may not be obtained.

—Photothermal Conversion Layer—

The photothermal conversion layer includes a photothermal conversion material which has a role of absorbing the laser light with high efficiency and generating heat. The photothermal conversion material may be included in at least one of proximal layers of the thermoreversible recording layer. When the photothermal conversion material is included in the thermoreversible recording layer, the thermoreversible recording layer also serves as the photothermal conversion layer. Also, there are cases where a barrier layer is formed between the thermoreversible recording layer and the photothermal conversion layer for the purpose of inhibiting interaction between these layers, and a layer including a material having favorable thermal conductivity is preferable. The layer sandwiched between the thermoreversible recording layer and the photothermal conversion layer may be appropriately selected according to purpose, and it is not restricted thereto.

The photothermal conversion material may be divided into an inorganic material and an organic material.

Examples of the inorganic material include: carbon black; and metals or semimetals such as Ge, Bi, In, Te, Se and Cr, and alloys, metal boride particles and metal oxide particles thereof. Examples of the metal boride particles and the metal oxide particles include hexaboride, tungsten oxide compound, antimony-doped tin oxide (ATO), tin-doped indium oxide (ITO) and zinc antimonate.

As the organic material, various dyes may be appropriately used according to a light wavelength to be absorbed. When a laser diode is used as a light source, near-infrared absorbing dyes having an absorption peak in a wavelength region of 700 nm to 1,500 nm are used. Examples of the near-infrared absorbing dyes include cyanine dyes, quinone dyes, quinoline derivatives such as indonaphthol, phenylenediamine nickel complex and phthalocyanine compounds. The near-infrared absorbing dyes may be used alone or in combination of two or more.

Among these, the photothermal conversion material preferably has high heat resistance for repeated image processing, and in this viewpoint, the phthalocyanine compounds are particularly preferable.

When the photothermal conversion layer is provided, the photothermal conversion material is used in combination with a resin. The resin used in the photothermal conversion layer is not particularly restricted, and it may be appropriately selected according to purpose. Nonetheless, a thermoplastic resin, a thermosetting resin and so on are preferable, and the binder resin used for the thermoreversible recording layer may also be favorably used. Among these, a resin curable by heat, ultraviolet light, electron beam and so on is preferable in order to improve repetition durability, and a thermal crosslinking resin with which an isocyanate compound is used as a crosslinking agent is particularly preferable. The binder resin has a hydroxyl value of preferably 50 mgKOH/g to 400 mgKOH/g.

An average thickness of the photothermal conversion layer is not particularly restricted, and it may be appropriately selected according to purpose. Nonetheless, it is preferably 0.1 μm to 20 μm.

—First Oxygen Barrier Layer and Second Oxygen Barrier Layer—

The first oxygen barrier layer and the second oxygen barrier layer are preferably provided on a top and a bottom of the thermoreversible recording layer for the purpose of preventing oxygen from entering into the thermoreversible recording layer and thereby to prevent photodegradation of the leuco dye in the thermoreversible recording layer.

For the first oxygen barrier layer and the second oxygen barrier layer, a resin or a polymer film with a visible portion having a high transparency and a low oxygen permeability. The oxygen barrier layer is selected according to its use, oxygen permeability, transparency, ease of coating, adhesiveness and so on. Examples of the oxygen barrier layer include a silica-deposited film, an alumina-deposited film and a silica/alumina-deposited film that inorganic oxide is deposited on a resin such as polyacrylic acid alkyl ester, polymethacrylic acid alkyl ester, polymethacrylonitrile, polyalkyl vinyl ester, polyalkyl vinyl ether, polyvinyl fluoride, polystyrene, vinyl acetate copolymer, cellulose acetate, polyvinyl alcohol, polyvinylidene chloride, acetonitrile copolymer, vinylidene chloride copolymer, poly(chlorotrifluoroethylene), ethylene-vinyl alcohol copolymer, polyacrylonitrile, acrylonitrile copolymer, polyethylene terephthalate, nylon-6 and polyacetal or a polymer film such as polyethylene terephthalate and nylon. Among these, the film that inorganic oxide is deposited on a polymer film is particularly preferable.

Oxygen permeability of the oxygen barrier layer is not particularly restricted, and it may be appropriately selected according to purpose. Nonetheless, it is preferably 20 mL/m$^2$/day/MPa or less, more preferably 5 mL/m$^2$/day/MPa or less, and further more preferably 1 mL/m$^2$/day/MPa or less. When the oxygen permeability exceeds 20 mL/m$^2$/day/MPa, there are cases where light degradation of the leuco dye in the thermoreversible recording layer cannot be suppressed.

The oxygen permeability may be measured by a measurement method according to JIS K7126 B, for example.

The oxygen barrier layer may be provided below the thermoreversible recording layer or behind the substrate such that the oxygen barrier layer sandwiches the thermoreversible recording layer. Thereby, it is possible to prevent more effectively oxygen from penetrating into the thermoreversible recording layer, and light degradation of the leuco dye may further be reduced.

A method for forming the first oxygen barrier layer and the second oxygen barrier layer is not particularly restricted, may be appropriately selected according to purpose. Examples thereof include a melt-extrusion method, a coating method and a laminate method.

An average thickness of the first oxygen barrier layer and the second oxygen barrier layer is not particularly restricted, and it varies depending on the oxygen permeability of the resin or the polymeric film. Nonetheless, it is preferably 0.1 μm to 100 μm. The average thickness being too small results in incomplete oxygen barrier and being too large results in reduced transparency, which are not preferable.

An adhesive layer may be disposed between the oxygen barrier layer and a lower layer. A method for forming the adhesive layer is not particularly restricted, and it may be appropriately selected according to purpose. Examples thereof include an ordinary coating method and laminate method. An average thickness of the adhesive layer is not particularly restricted, and it may be appropriately selected according to purpose. Nonetheless, it is preferably 0.1 μm to 5 μm. The adhesive layer may be cured by a crosslinking agent. As the crosslinking agent, those used for the thermoreversible recording layer may be favorably used.

—Protective Layer—

It is preferable to provide a protective layer on the thermoreversible recording layer in the thermoreversible recording medium for the purpose of protecting the thermoreversible recording layer. The protective layer is not particularly restricted, and it may be appropriately selected according to purpose. For example, it may be formed as one or more layers, and it is preferable to dispose it on an exposed outermost surface.

The protective layer includes a binder resin, and it includes other components such as releasing agent and filler according to necessity.

The binder resin of the protective layer is not particularly restricted, and it may be appropriately selected according to purpose. Examples thereof include a thermosetting resin, an ultraviolet (UV) hardening resin and an electron-beam curing resin. Among these, the UV curing resin and the thermosetting resin are particularly preferable.

The UV curing resin can form an extremely hard film after curing, and it is possible to suppress deformation of the recording medium caused by damages due to physical contacts on a surface thereof and laser heating. Thus, the obtained thermoreversible recording medium has superior repetition durability.

Also, the thermosetting resin can harden the surface similarly but slightly inferior to the UV hardening resin, and it provides superior repetition durability.

The UV curing resin is not particularly restricted, may be appropriately selected according to purpose. Examples thereof include urethane acrylate oligomers, epoxy acrylate oligomers, polyester acrylate oligomers, polyether acrylate oligomers, vinyl oligomers, unsaturated polyester oligomers, and monomers such as various monofunctional or polyfunctional acrylates, various monofunctional or polyfunctional methacrylates, vinyl esters, ethylene derivatives and allyl compounds. Among these, the polyfunctional monomers or the oligomers containing four or more functional groups are particularly preferable. By mixing two or more types of these monomers or oligomers, hardness, degree of contraction, flexibility and coating strength of the resin film may be appropriately adjusted.

Also, in order to cure the monomer or the oligomer using an ultraviolet light, it is necessary to use a photopolymerization initiator or a photopolymerization accelerator.

A content of the photopolymerization initiator or the photopolymerization accelerator is not particularly restricted, and it may be appropriately selected according to purpose. Nonetheless, it is preferably 0.1% by mass to 20% by mass, and more preferably 1% by mass to 10% by mass with respect to the total mass of the resin component of the protective layer.

Ultraviolet irradiation for curing the UV curing resin is not particularly restricted, and it may be appropriately selected according to purpose. Examples thereof include an ultraviolet irradiation apparatus. The ultraviolet irradiation apparatus is equipped with, for example, a light source, lighting, a power supply, a cooling device and a conveying device.

Examples of the light source include a mercury lamp, a metal halide lamp, a potassium lamp, a mercury-xenon lamp and a flash lamp. A wavelength of the light source may be appropriately selected according to an UV absorption wavelength of the photopolymerization initiator and the photopolymerization accelerator added to the thermoreversible recording medium.

Conditions of the ultraviolet irradiation are not particularly restricted, and they may be appropriately selected according to purpose. For example, a lamp power, a conveying speed and so on may be determined according to the irradiation energy required for curing the resin.

As the thermosetting resin, for example, those similar to the binder resin used for the thermoreversible recording layer may be favorably used.

The thermosetting resin is preferably crosslinked. As the thermosetting resin, it is preferable to use a resin containing a group reactive with a curing agent such as hydroxyl group, amino group and carboxyl group, and a polymer containing a hydroxyl group is preferable.

As the curing agent, for example, the curing agent similar to those used for the thermoreversible recording layer may be favorably used.

For the sake of transportability, examples of the releasing agent include: a silicone containing a polymerizable group and a silicone-grafted polymer; and wax, zinc stearate and silicone oil.

A content of the releasing agent is not particularly restricted, and it may be appropriately selected according to purpose. Nonetheless, it is preferably 0.01% by mass to 50% by mass, and more preferably 0.1% by mass to 40% by mass with respect to the total mass of the resin component of the protective layer.

As the filler, it is preferable to use an electrically conductive filler as an antistatic measure, and a needle-like electrically conductive filler is particularly preferable.

To the protective layer, a pigment, a surfactant, a leveling agent, an antistatic agent and so on may further be added according to necessity.

For a coating solution of the protective layer, heretofore known methods used for the thermoreversible recording layer may be used for a solvent, a dispersion apparatus of the coating solution, a coating method of the protective layer and a drying method. Here, when the UV curing resin is used, a curing step by ultraviolet irradiation is required after coating and drying, and an ultraviolet irradiation apparatus, a light source, and irradiation conditions are as described above.

An average thickness of the protective layer is not particularly restricted, and it may be appropriately selected according to purpose. Nonetheless, it is preferably 0.1 μm to 20 μm, more preferably 0.5 μm to 10 μm, and further more preferably 1.5 μm to 6 μm. When the average thickness is less than 0.1 μm, it cannot fulfill the full function as a protective layer of the thermoreversible recording medium. As a result, the medium degrades quickly due to repeated recording by heat, and it may not be repeatedly used. When the average thickness exceeds 20 μm, sufficient heat cannot be transferred to the thermoreversible recording layer below the protective layer. As a result, there are cases where image recording and image erasing by heat cannot be carried out sufficiently.

—Ultraviolet Absorbing Layer—

In the present invention, an ultraviolet absorbing layer is preferably disposed on a surface of the substrate opposite to the side of the thermoreversible recording layer for the purpose of preventing residual image due to coloring or light degradation of the leuco dye in the thermoreversible recording layer due to ultraviolet light. Thereby, lightfastness of the thermoreversible recording medium may be improved.

The ultraviolet absorbing layer includes a binder resin and an ultraviolet absorber, and it further includes other components such as filler, lubricant, and colored pigment according to necessity.

The binder resin is not particularly restricted, and it may be appropriately selected according to purpose. A resin component such as the binder resins of the thermoreversible recording layer, thermoplastic resins and thermosetting resins may be used. Examples of the binder resin includes polyethylene, polypropylene, polystyrene, polyvinyl alcohol, polyvinyl butyral, polyurethane, saturated polyester, unsaturated polyester, an epoxy resin, a phenolic resin, polycarbonate and polyamide.

As the ultraviolet absorber, any of organic and inorganic compounds may be used.

Also, it is preferable to use a polymer having an ultraviolet absorbing structure (Hereinafter, it may also be referred to as an "UV-absorbing polymer").

Here, the polymer having an ultraviolet absorbing structure means a polymer having an ultraviolet absorbing structure (e.g., ultraviolet absorbing group) within the molecule. Examples of the ultraviolet absorbing structure include a salicylate structure, a cyanoacrylate structure, a benzotriazole structure and a benzophenone structure. Among these, the benzotriazole structure and the benzophenone structure are particularly preferable since they absorb an ultraviolet light of 340 nm to 400 nm, which is a cause of light degradation of the leuco dye.

The UV-absorbing polymer is preferably crosslinked. As the UV-absorbing polymer, it is preferable to use a polymer containing a group reactive with a curing agent such as hydroxyl group, amino group and carboxyl group, and a polymer containing a hydroxyl group is particularly preferable. In order to improve strength of a layer containing a polymer having the ultraviolet absorbing structure, sufficient film strength may be obtained when a polymer having a hydroxyl value of 10 mgKOH/g or greater. It is more preferably 30 mgKOH/g or greater, and more preferably 40 mgKOH/g or greater. In this way, by providing sufficient film strength, it is possible to suppress degradation of the thermoreversible recording medium even after repetitive erasing and recording.

An average thickness of the ultraviolet absorbing layer is not particularly restricted, and it may be appropriately selected according to purpose. Nonetheless, it is preferably 0.1 μm to 30 μm, and more preferably 0.5 μm to 20 μm. For a coating solution of the ultraviolet absorbing layer, heretofore known methods used for the thermoreversible recording layer may be used for a solvent, a coating method of the ultraviolet absorbing layer and a drying and curing method of the ultraviolet absorbing layer.

—Intermediate Layer—

In the present invention, an intermediate layer is preferably disposed between the thermoreversible recording layer and the protective layer for the purpose of improving adhesion between the thermoreversible recording layer and the protective layer, preventing alteration of the thermoreversible recording layer due to coating of the protective layer and preventing migration of additives in the protective layer to the thermoreversible recording layer. By providing the intermediate layer, storage stability of a color image may be improved.

The intermediate layer includes a binder resin, and it further includes other components such as filler, lubricant and colored pigment according to necessity.

The binder resin is not particularly restricted, and it may be appropriately selected according to purpose. Resin components including the binder resin of the thermoreversible recording layer, thermoplastic resins and thermosetting resins may be used. Examples of the resin component include polyethylene, polypropylene, polystyrene, polyvinyl alcohol, polyvinyl butyral, polyurethane, saturated polyester, unsaturated polyester, an epoxy resin, a phenolic resin, polycarbonate and polyamide.

The intermediate layer preferably includes an ultraviolet absorber. The ultraviolet absorber is not particularly restricted, and any of an organic compound and an inorganic compound may be used. Also, an UV-absorbing polymer may be used, and it may be cured by a crosslinking agent. As these, those used for the protective layer may be favorably used.

An average thickness of the intermediate layer is not particularly restricted, and it may be appropriately selected according to purpose. Nonetheless, it is preferably 0.1 μm to 20 μm, and more preferably 0.5 μm to 5 μm. For a coating solution of the intermediate layer, heretofore known methods used for the thermoreversible recording layer may be used for a solvent, a dispersion apparatus of the coating solution, a coating method of the intermediate layer and a drying and curing method of the intermediate layer.

—Under Layer—

In the present invention, an under layer may be disposed between the thermoreversible recording layer and the substrate in order to increase sensitivity by making effective use of applied heat or for the purpose of improving adhesion between the substrate and the thermoreversible recording layer and preventing penetration of the thermoreversible recording layer materials into the substrate.

The under layer includes hollow particles, and it further includes a binder resin and other components according to necessity.

Examples of the hollow particles include: single-hollow particles having one hollow portion in a particle; and multi-hollow particles having a plurality of hollow portions in a particle. These may be used alone or in combination of two or more.

A material of the hollow particles is not particularly restricted, and it may be appropriately selected according to purpose. Nonetheless, favorable examples thereof include a thermoplastic resin. The hollow particles is not particularly restricted, and it may be appropriately produced or a commercial product. Examples of the commercial products include MICROSPHERE R-300 (manufactured by Matsumoto Yushi-Seiyaku Co., Ltd.); ROPAQUE HP1055 and ROPAQUE HP433J (both manufactured by Zeon Corporation); and SX866 (manufactured by JSR Corporation).

A content of the hollow particles in the under layer is not particularly restricted, and it may be appropriately selected according to purpose. Nonetheless, it is preferably 10% by mass to 80% by mass.

As the binder resin, the resins similar to those used for the thermoreversible recording layer or the layer including the polymer having an ultraviolet absorbing structure may be used.

The under layer may further include a filler, a lubricant, a surfactant, a dispersant and so on according to necessity.

Examples of the filler include an inorganic filler and an organic filler, and the inorganic filler is preferable. Examples of the inorganic filler include calcium carbonate, magnesium carbonate, titanium oxide, silicon oxide, aluminum hydroxide, kaolin and talc.

An average thickness of the under layer is not particularly restricted, and it may be appropriately selected according to purpose. Nonetheless, it is preferably 0.1 μm to 50 μm, more preferably 2 μm to 30 μm, and further more preferably 12 μm to 24 μm.

—Back Layer—

A back layer may be disposed on a surface of the substrate opposite to the surface on which the thermoreversible recording layer is disposed for anti-curl and anti-static purposes and improved transportability of the thermoreversible recording medium.

The back layer includes a binder resin, and it further includes other components such as filler, electrically conductive filler, lubricant, and coloring pigment according to necessity.

The binder resin is not particularly restricted, and it may be appropriately selected according to purpose. Examples thereof include a thermosetting resin, an ultraviolet (UV) hardening resin and an electron-beam hardening resin. Among these, the ultraviolet (UV) hardening resin and the thermosetting resin are particularly preferable.

As the UV curing resin, the thermosetting resin, the filler, the electrically conductive filler and the lubricant, those used for the thermoreversible recording layer or the protective layer may be favorably used.

—Adhesive Layer or Tacky Layer—

In the present invention, a thermoreversible recording label may be provided by disposing an adhesive layer or a tacky layer on a surface of the substrate opposite to the surface on which thermoreversible recording layer is formed. As a material for the adhesive layer or the tacky layer, those commonly used may be used.

A material of the adhesive layer or the tacky layer is not particularly restricted, and it may be appropriately selected according to purpose. Examples thereof include a urea resin, a melamine resin, a phenolic resin, an epoxy resin, a vinyl acetate resin, a vinyl acetate-acrylic copolymer, an ethylene-vinyl acetate copolymer, an acrylic resin, a polyvinyl ether resin, a vinyl chloride-vinyl acetate copolymer, a polystyrene resin, a polyester resin, a polyurethane resin, a polyamide resin, a chlorinated polyolefin resin, a polyvinyl butyral resin, an acrylate copolymer, a methacrylate copolymer, a natural rubber, a cyanoacrylate resin and silicone resin.

The material of the adhesive layer or the tacky layer may be of a hot-melt type. A release paper may be used, or the medium may be without a release paper. By providing the adhesive layer or the tacky layer, a recording layer may be pasted on the whole or a part of the surface of a thick substrate of a vinyl chloride card with a magnetic stripe on which application of a recording layer is difficult. Thereby, a part of information stored in the magnetic stripe may be displayed, and this recording medium becomes more convenient. Such a thermoreversible recording label with the adhesive layer or the tacky layer is also applicable to thick cards such as IC card and optical card.

A colored layer may be disposed between the substrate and the recording layer of the thermoreversible recording medium for the purpose of improving visibility. The colored layer may be formed by applying and drying a solution or a dispersion liquid including a colorant and a resin binder on a target surface, or simply by pasting a colored sheet.

A color print layer may be disposed on the thermoreversible recording medium. Examples of a colorant in the color print layer include various dyes and pigments included in a color ink used for conventional full-color printing. Examples of the resin binder include various thermoplastic resins, thermosetting resins, ultraviolet hardening resins and electron-beam hardening resin. A thickness of the color print layer appropriately changed according to the printing color density, and thus it may be selected according to the desired printing color density.

The thermoreversible recording medium may be used in combination with an irreversible recording layer. In this case, each recording layer has an identical or different color tone. Also, a colored layer with an arbitrary picture formed by printing such as offset printing and gravure printing or by an inkjet printer, thermal transfer printer or a sublimation printer may be disposed on a partial or an entire surface of an identical surface or a part of an opposite surface of the thermoreversible recording layer of the thermoreversible recording medium, and further an OP varnish layer composed mainly of a hardening resin may be disposed on an entire or a partial surface of the colored layer. Examples of the arbitrary picture include characters, patterns, designs, photographs and information to be detected by infrared. Also, any of the constituting layers may be colored by adding a dye or a pigment.

It is also possible to provide a hologram for security to the thermoreversible recording medium. Also, for imparting design, a design of a figure, a company emblem or a symbol mark may be provided by relief or intaglio.

The thermoreversible recording medium may be processed into a desired shape according to its use, and examples of the shape include shapes of a card, a tag, a label, a sheet and a roll.

Examples of those processed into the card shape include a prepaid card, a reward card and a credit card. A tag-shaped medium having a size smaller than the size of the card may be used for a price tag and so on. Also, a tag-shaped medium having a size larger than the size of the card may be used for process management, shipping instruction, ticket and so on. Since it may be pasted, a label-shaped medium is processed into various sizes and used for process management, commodities management and so on by pasting it on a cart, a container, a box, a container and so on which are repeatedly used. Also, the sheet having a size larger than the card has a larger image recording area, and thus it may be used as an instruction for a general document, process management.

Figure 8A:
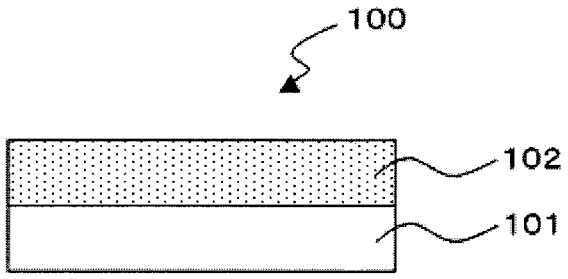
FIG. 8A is a schematic cross-sectional diagram illustrating one example of a layer configuration of a thermoreversible recording medium.

Here, a layer configuration of the thermoreversible recording medium 100 is not particularly restricted, and examples thereof include an aspect, as illustrated in FIG. 8A, including: a substrate 101; and a thermoreversible recording layer 102 including a photothermal conversion material on the substrate.

Figure 8B:
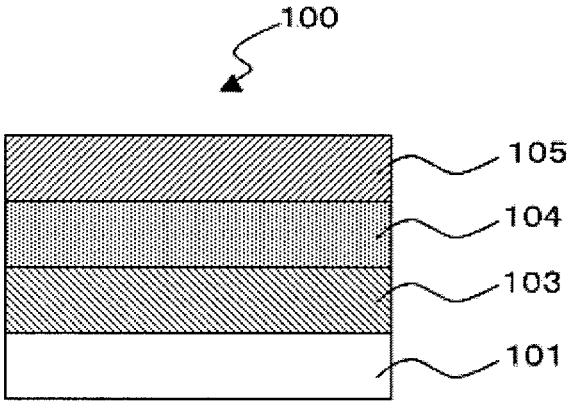
FIG. 8B is a schematic cross-sectional diagram illustrating another example of a layer configuration of a thermoreversible recording medium.

The examples also include an aspect, as illustrated in FIG. 8B, including: a substrate 101; and a first thermoreversible recording layer 103, a photothermal conversion layer 104 and a second thermoreversible recording layer 105 in recited order on the substrate.

Figure 8C:
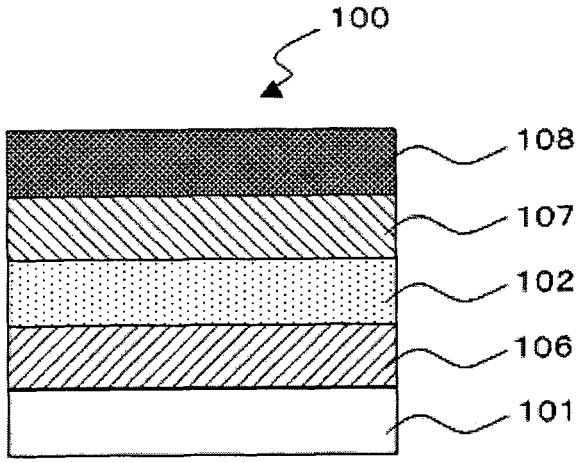
FIG. 8C is a schematic cross-sectional diagram illustrating another example of a layer configuration of a thermoreversible recording medium.

The examples also include an aspect, as illustrated in FIG. 8C, including: a substrate 101; and a first oxygen barrier layer 106, a thermoreversible recording layer 102 including a photothermal conversion material, a second oxygen barrier layer 107 and an ultraviolet absorbing layer 108 in recited order on the substrate.

Figure 8D:
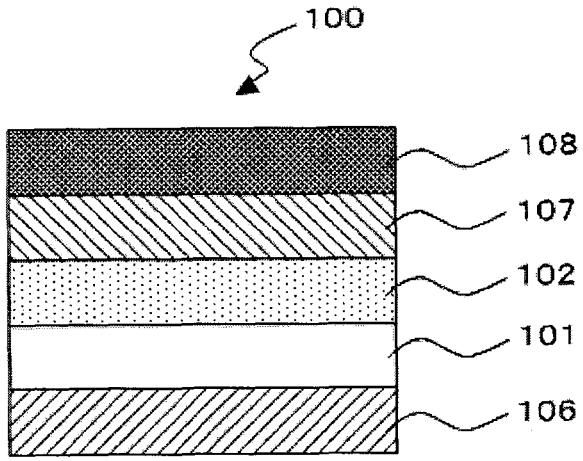
FIG. 8D is a schematic cross-sectional diagram illustrating another example of a layer configuration of a thermoreversible recording medium.

The examples also include an aspect, as illustrated in FIG. 8D, including: a substrate 101; a thermoreversible recording layer 102 including a photothermal conversion material, a second oxygen barrier layer 107 and an ultraviolet absorbing layer 108 in recited order on the substrate; and a first oxygen barrier layer 106 on a surface of the substrate 101 on which the thermoreversible recording layer is not included.

Here, although not shown, a protective layer may be formed on an outermost layer of the thermoreversible recording layer 102 in FIG. 8A, the second thermoreversible recording layer 105 in FIG. 8B, the ultraviolet absorbing layer 108 in FIG. 8C, and the ultraviolet absorbing layer 108 in FIG. 8D.

<Image Recording and Image Erasing Mechanism>

The image recording and image erasing mechanism in the present invention is an aspect that color tone changes reversibly by heat. The aspect is composed of a leuco dye and a reversible color developing agent (hereinafter, it may also be referred to as a "color developer"), and a color toner reversibly changes between a transparent state and a colored state by heat.

Figure 9A:
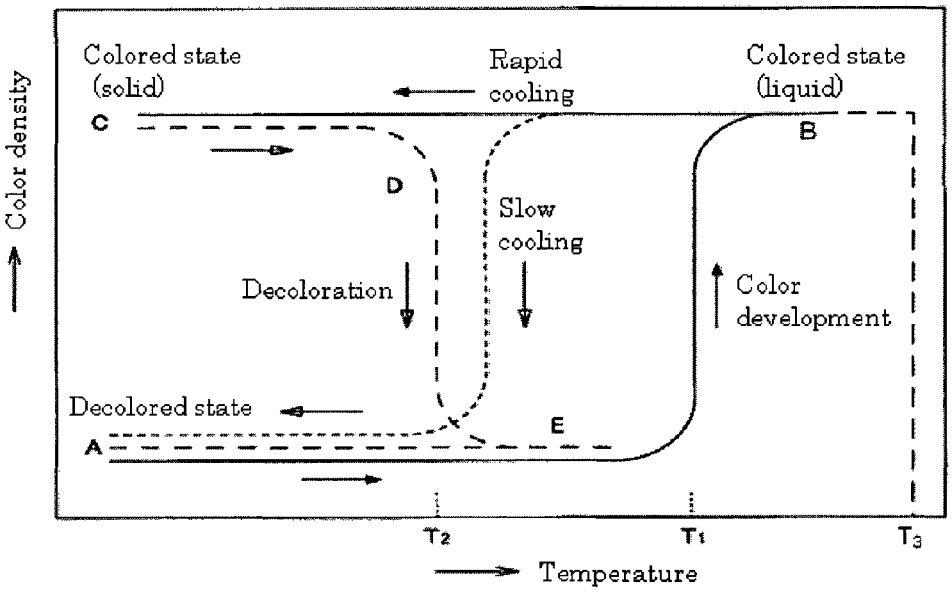
FIG. 9A is a diagram illustrating color-forming and color-erasing characteristics of a thermoreversible recording medium.
Figure 9B:
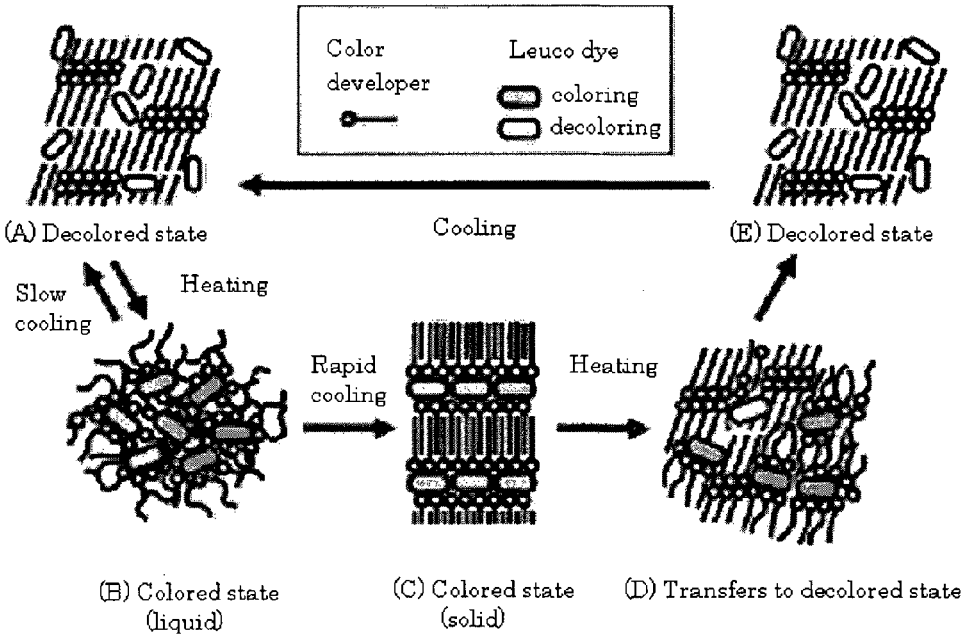
FIG. 9B is a schematic explanatory diagram illustrating a color-forming and color-erasing mechanism of a thermoreversible recording medium.

FIG. 9A illustrates one example a temperature-color density change curve of a thermoreversible recording medium including a thermoreversible recording layer which includes the leuco dye and the color developer in the resin. FIG. 9B illustrates a coloring and decoloring mechanism of the thermoreversible recording medium, where the transparent state and the colored state reversibly changes by heat.

First, as the recording layer in a decolored state A is heated, the leuco dye and the color developer are melt-mixed at a melting temperature $T_1$. It develops a color and becomes a melted and colored state B. When it is rapidly cooled from the melted and colored state B, it is allowed to cool to a room temperature while retaining its colored state becomes a colored state C with its colored state stabilized and fixed. Whether or not this colored state is obtained depends on a cooling rate from the melted state. When it is cooled slowly, decoloration occurs in the course of cooling, and it becomes the initial decolored state A or a state with a low density relative to the colored state C by rapid cooling. On the other hand, when it is heated again from the colored state C, decoloration occurs at a temperature $T_2$, which is lower than the coloring temperature (D to E). When it is cooled from this state, it returns to the initial decolored state A.

The colored state C obtained by rapid cooling from a melted state is a state where the leuco dye and the color developer are mixed while they as molecules may contact and react with one another, and in many cases, it forms a solid state. In this state, a melt mixture of the leuco dye and the color developer (the color mixture) are crystallized, and its color is maintained. It is considered that the color is stable because of the formation of this structure. On the other hand, the decolored state is a state that they are in a condition of phase separation. In this state, molecules of at least one of the compounds aggregate to form a domain or crystallize. It is considered that the leuco dye and the color developer are separated and in a stable state by aggregation or crystallization. In many cases, complete decoloration occurs when they are of phase separation and the color developer crystallizes.

Here, in both the decoloration from a melted state by slow cooling and the decoloration from a colored state by heating illustrated in FIG. 9A, an aggregation structure changes at $T_2$, where the phase separation and the crystallization of the color developer occur.

Further, in FIG. 9A, there are cases where poor erasing occurs that erasing is impossible despite heating to an erasing temperature when the recording layer is repeatedly heated to a temperature $T_3$ above the melting temperature $T_1$. A reason thereof is presumed that the color developer thermally decomposes, making aggregation or crystallization difficult, and that it becomes difficult to be separated from the leuco dye. Degradation of the thermoreversible recording medium can be suppressed by reducing the difference between the melting temperature $T_1$ and the temperature $T_3$ in FIG. 9A when the thermoreversible recording medium is heated.

<Example of Combination with Thermoreversible Recording Member RF-ID>

As a thermoreversible recording member used in the present invention, the reversibly displayable recording layer and an information storage unit are provided on an identical card or tag (integrated), and a part of stored information in the information storage unit is displayed on the recording layer. Thereby, the information may be confirmed only by viewing the card or the tag without a special device, which is convenient. Also, when a content of the information storage unit is rewritten, the display of the thermoreversible recording unit is also rewritten. Thereby, the thermoreversible recording medium may be repeatedly used.

The information storage unit is not particularly restricted, and it may be appropriately selected according to purpose. Examples thereof include a magnetic recording layer, a magnetic stripe, an IC memory, an optical memory and an RF-ID tag. For process management, commodities management and so on, the RF-ID tag is preferable. The RF-ID tag is formed with an IC chip, and an antenna connected to the IC chip.

The thermoreversible recording member includes a reversibly displayable recording layer and an information storage unit, and favorable examples of the information storage unit include the RF-ID tag.

With an image erasing method and an image erasing apparatus of the present invention, a repetitive erasing is possible in a non-contact manner on a thermoreversible recording medium such as label attached to a container such as cardboard and plastic container. Thus, it is particularly favorably used for a logistics delivery system. In this case, for example, an image is formed or erased on the label while the cardboard or the plastic container placed on a belt conveyor is being conveyed. It is unnecessary to stop a line, and it is possible to shorten a shipping time.

Also, the label on the cardboard and the plastic container may be reused as it is without being detached therefrom, and an image may be erased and formed again.

EXAMPLES

Hereinafter, the present invention is further described in detail with reference to Examples, which however shall not be construed as limiting the scope of the present invention.

Production Example 1

Production of Thermoreversible Recording Medium

A thermoreversible recording medium whose color tone changes reversibly by heat was prepared as follows.

—Substrate—

As a substrate, a white polyester film having an average thickness of 125 μm (TETORON (registered trademark) film U2L98W, manufactured by Teijin DuPont Films Japan) was prepared.

—Under Layer—

An under layer coating solution was prepared by adding 30 parts by mass of a styrene-butadiene copolymer (PA-9159, manufactured by Nippon A&L Inc.), 12 parts by mass of a polyvinyl alcohol resin (POVAL PVA103, manufactured by Kuraray Co., Ltd.), 20 parts by mass of hollow particles (MICROSPHERE R-300, manufactured by Matsumoto Yushi-Seiyaku Co., Ltd.) and 40 parts by mass of water and stirring the mixture for 1 hour until it became uniform.

Next, the obtained under layer coating solution was applied on the substrate using a wire bar, which was heated and dried at 80° C. for 2 minutes, and an under layer having an average thickness of 20 μm was formed.

—Thermoreversible Recording Layer—

Using a ball mill, 5 parts by mass of a reversible color developing agent represented by Structural Formula (1) below, 0.5 parts by mass, respectively, of two types of decoloring accelerators represented by Structural Formula (2) below and Formula (3) below, 10 parts by mass of a 50-% by mass solution of acrylic polyol (hydroxyl value=200 mgKOH/g) and 80 parts by mass of methyl ethyl ketone were pulverized and dispersed until an average particle diameter became about 1 μm.

<Structural Formula (1)>

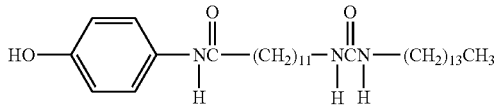

<Structural Formula (2)>

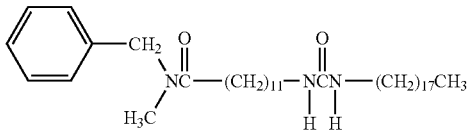

<Formula (3)>

$C_{17}H_{35}CONHC_{18}H_{37}$

Next, to the dispersion liquid in which the reversible color developing agent was pulverized and dispersed, 1 part by mass of 2-anilino-3-methyl-6-diethylaminofluoran as a leuco dye, 1.2 parts by mass of a 1.85-% by mass dispersion solution of $LaB_6$ as a photothermal conversion material (KHF-7A, manufactured by Sumitomo Metal Mining Co., Ltd.) and 5 parts by mass of an isocyanate (CORONATE HL, manufactured by Nippon Polyurethane Industry Co., Ltd.) were added and stirred well, and thereby a thermoreversible recording layer coating solution was prepared.

Next, the obtained thermoreversible recording layer coating solution was applied on the under layer using a wire bar. It was heated and dried at 100° C. for 2 minutes followed by curing at 60° C. for 24 hours, and thereby a thermoreversible recording layer having an average thickness of 10 μm was formed.

—Ultraviolet Absorbing Layer—

An ultraviolet absorbing layer coating solution was prepared by adding and stirring well 10 parts by mass of a 40-% by mass solution of an UV-absorbing polymer (UV-G302, manufactured by Nippon Shokubai Co., Ltd.), 1.0 part by mass of an isocyanate (CORONATE HL, manufactured by Nippon Polyurethane Industry Co., Ltd.) and 12 parts by mass of methyl ethyl ketone.

Next, the ultraviolet absorbing layer coating solution was applied on the thermoreversible recording layer with a wire bar, and it was heated and dried at 90° C. for 1 minute followed by heating at 60° C. for 24 hours. Thereby, an ultraviolet absorbing layer having a thickness of 10 μm was formed.

—Oxygen Barrier Layer—

An adhesive layer coating solution was prepared by adding and stirring well 5 parts by mass of an urethane adhesive (TM-567, manufactured by Toyo-Morton, Ltd.), 0.5 parts by mass of an isocyanate (CAT-RT-37, manufactured by Toyo-Morton, Ltd.) and 5 parts by mass of ethyl acetate.

Next, the adhesive layer coating solution was applied with a wire bar on a silica-deposited PET film [IB-PET-C, manufactured by Dai Nippon Printing Co., Ltd.; oxygen permeability: 15 mL/($m^2$·day·MPa)], and it was heated and dried at 80° C. for 1 minute. This was laminated with the ultraviolet absorbing layer and heated at 50° C. for 24 hours, and thereby, an oxygen barrier layer having an average thickness of 12 μm was formed.

—Back Layer—

A back layer coating solution was prepared by adding and stirring well in a ball mill 7.5 parts by mass of pentaerythritol hexaacrylate (KAYARAD DPHA, manufactured by Nippon Kayaku Co., Ltd.), 2.5 parts by mass of an urethane acrylate oligomer (ART-RESIN UN-3320HA, manufactured by Negami Chemical Industrial Co., Ltd.), 0.5 parts by mass of a photopolymerization initiator (IRGACURE 184, manufactured by Nihon Ciba-Geigy K.K.) and 13 parts by mass of isopropyl alcohol.

Next, the back layer coating solution was applied with a wire bar on a surface of the substrate on which the thermoreversible recording layer was not formed. It was heated and dried at 90° C. for 1 minute and then crosslinked by irradiating an UV lamp at 80 W/cm, and thereby a back layer having an average thickness of 4 μm was formed. By the above, the thermoreversible recording medium of Production Example 1 was prepared.

Example 1

Image Recording Step

A laser diode BMU25-975-01-R, manufactured by Oclaro Inc. (center wavelength: 976 nm), was used for the prepared thermoreversible recording medium of Production Example 1, and it was adjusted such that a laser power was 19.3 W, an irradiation distance was 175 mm, a spot diameter was about 0.50 mm, a line width was 0.25 mm and a scanning speed was 3,000 mm/s.

A laser light was scanned as illustrated in FIG. 4 with a drawing pitch of laser drawn lines adjacent to each other of 0.125 mm, a laser power of a first line of 19.3 W, a laser power of a second line of 17.0 W and a laser power of a third line of 18.0 W.

Under the above image recording conditions, a bar code (ITF) denoted in Table 1 below was drawn, and an image quality of the bar code was evaluated as follows. Results are shown in Table 3-1.

TABLE 1

| Bar code type | Drawing content | Bar code height | Number of lines of narrow bars | Number of lines of wide bars |
|---|---|---|---|---|
| ITF | 123456789 | 8 mm | 1 | 3 |

*The bar code (ITF) is composed of bars with thicknesses varied in two stages, namely a narrow bar and a wide bar. In Examples and Comparative Examples, it is applied to the wide bar.

<Evaluation of Image Quality of Bar Code>

The image quality of the bar code was evaluated by reading the image by a one-dimensional code reader (WEBSCAN TRUCHECK 401-RL, manufactured by WEBSCAN Inc.) and measuring a modulation value and a decodability value. Here, grades of the modulation value are defined as: A when it is greater than 70; B when it is 60 or greater; C when it is 50 or greater; D when it is 40 or greater; and F when it is less than 40. Grades of the decodability value are defined as: A when it is greater than 62; B when it is 50 or greater; C when it is 37 or greater; D when it is 25 or greater; and F when it is less than 25.

—Image Erasing Step—

Next, the laser light was adjusted so that the laser power was 20 W, the irradiation distance was 130 mm, the spot diameter was about 3 mm, and the scanning speed was 650 mm/s. Then, it was irradiated by 20 scans so that the resulting drawing pitch was 0.6 mm, and the image was completely erasable.

Image recording and image erasing were repeated under the above conditions, and the medium was visually observed. Uniform image recording and erasing were possible up to 500 repetitions. However, erasing traces of the image became noticeable after 600 times, and uniform erasing was no longer possible.

Image evaluation, an evaluation method of the repetition durability test, and the evaluation criteria are described below. Results are shown in Table 3-2.

[Image Evaluation]

A: The recorded image was formed with a uniform density and an appropriate line width, and the bar code readability was grade C or greater.

F: The recorded image was not formed with a uniform density and an appropriate line width, and the bar code readability was grade D or below.

[Evaluation Criteria of Repetition Durability Test]

A: Uniform image recording and erasing were possible even when the repetition of image recording and image erasing was 1,000 times or greater.

B: Uniform image recording and erasing were possible when the repetition of image recording and image erasing was 500 times to 999 times.

F: Uniform image recording and erasing were possible when the repetition of image recording and image erasing was less than 500 times.

Example 2

A bar code was drawn in the same manner as Example 1 except that each of the second and subsequent laser drawn lines in Example 1 was divided into 10 segments from a starting point to an end point and that the scanning speedscanning speed was decremented in a stepwise manner with the scanning speedscanning speed at the starting point of 4,200 mm/s, the scanning speedscanning speed at the end point of 3,000 mm/s and the decrement of 120 mm/s so that the irradiation energy increased in a stepwise manner from the starting point to the end point, and an image quality of the bar code was evaluated in the same manner as Example 1. Here, the irradiation energy of the first laser drawn line was uniform. Results are shown in Table 3-1.

Also, image erasing was carried out in the same manner as Example 1, and it was possible to erase the image completely.

Image recording and image erasing were repeated under the above conditions, and the medium was visually observed. Uniform recording and erasing of an image was possible up to 1,000 times. However, erasing traces of the image became noticeable after 1.100 times, and uniform erasing was no longer possible. Results of the image evaluation and the repetition durability test are shown in Table 3-2.

Example 3

A bar code was drawn in the same manner as Example 2 except that the laser power of the first line, the second line and the third line in Example 2 was changed to 19.3 W, 18.0 W and 17.0 W, respectively, and an image quality of the bar code was evaluated in the same manner as Example 1. Results are shown in Table 3-1.

Also, image erasing was carried out in the same manner as Example 1, and it was possible to erase the image completely.

Image recording and image erasing were repeated under the above conditions, and the medium was visually observed. Uniform image recording and erasing were possible up to 700 times, but, erasing traces of the image became noticeable after 800 times, and uniform erasing was no longer possible. Results of the image evaluation and the repetition durability test are shown in Table 3-2.

Comparative Example 1

A bar code was drawn in the same manner as Example 2 except that the laser power of the third line in Example 2 was changed to 17.0 W, and an image quality of the bar code was evaluated in the same manner as Example 1. Results are shown in Table 3-1.

Also, image erasing was carried out in the same manner as Example 1, and it was possible to erase the image completely.

Image recording and image erasing were repeated under the above conditions, and the medium was visually observed. Uniform image recording and erasing were possible up to 1,400 times. However, erasing traces of the image became noticeable after 1,500 times, and uniform erasing was no longer possible. Results of the image evaluation and the repetition durability test are shown in Table 3-2.

Comparative Example 2

A bar code was drawn in the same manner as Example 2 except that the laser power of the first line, the second line and the third line in Example 2 was changed to 17.0 W, 17.0 W and 17.0 W, respectively, and an image quality of the bar code was evaluated in the same manner as Example 1. Results are shown in Table 3-1.

Also, image erasing was carried out in the same manner as Example 1, and it was possible to erase the image completely.

Image recording and image erasing were repeated under the above conditions, and the medium was visually observed. Uniform image recording and erasing were possible even after 2,000 repetitions. Results of the image evaluation and the repetition durability test are shown in Table 3-2.

Comparative Example 3

A bar code was drawn in the same manner as Example 2 except that the laser power of the first line, the second line and the third line in Example 2 was changed to 19.3 W, 19.3 W and 19.3 W, respectively, and an image quality of the bar code was evaluated in the same manner as Example 1. Results are shown in Table 3-2.

Also, image erasing was carried out in the same manner as Example 1, and it was possible to erase the image completely.

Image recording and image erasing were repeated under the above conditions, and the medium was visually observed. Uniform image recording and erasing were possible up to 300 times, but, erasing traces of the image became noticeable after 400 times, and uniform erasing was no longer possible. Results of the image evaluation and the repetition durability test are shown in Table 3-2.

Comparative Example 4

A bar code was drawn in the same manner as Example 1 except that the laser power of the third line in Example 1 was changed to 17.0 W, and an image quality of the bar code was evaluated in the same manner as Example 1. Results are shown in Table 3-1.

Also, image erasing was carried out in the same manner as Example 1, and it was possible to erase the image completely.

Image recording and image erasing were repeated under the above conditions, and the medium was visually observed. Uniform image recording and erasing were possible up to 600 times. However, erasing traces of the image became noticeable after 700 times, and uniform erasing was no longer possible. Results of the image evaluation and the repetition durability test are shown in Table 3-2.

Comparative Example 5

Figure 3:
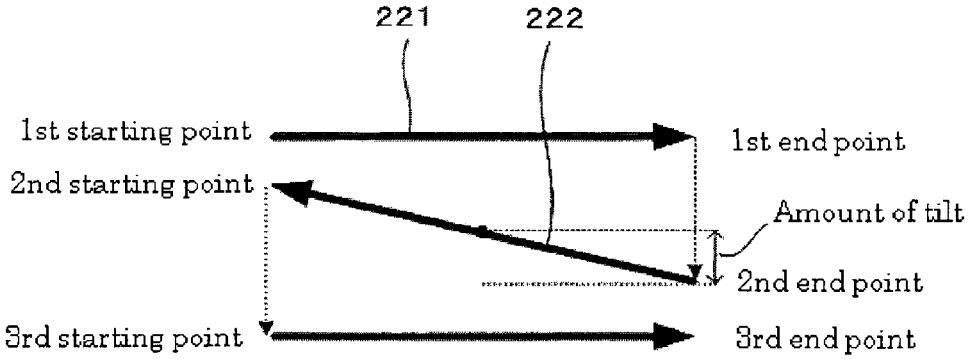
FIG. 3 is a schematic diagram illustrating another example of image recording by a conventional image processing method.

A bar code was drawn in the same manner as Example 2 except that the laser power of the first line, the second line and the third line in Example 2 was changed to 19.3 W, 17.0 W and 17.0 W, respectively, and that an amount of tilt from the starting point to the end point of the second line was set to 0.056 mm as illustrated in FIG. 3, and an image quality of the bar code was evaluated in the same manner as Example 1. Comparative Example 5 is a reproduction of a laser scanning method described in JP-A No. 2011-116116. Results are shown in Table 3-1.

Here, the amount of tilt is defined as a shortest distance between a central point of the second laser drawn line 222 in a length direction thereof and a line drawn from the second starting point in parallel with the first laser drawn line 221 in FIG. 3.

Also, image erasing was carried out in the same manner as Example 1, and it was possible to erase the image completely.

Image recording and image erasing were repeated under the above conditions, and the medium was visually observed. Uniform image recording and erasing were possible even after 2,000 repetitions. Results of the image evaluation and the repetition durability test are shown in Table 3-2.

Next, laser recording conditions of Example 1 to 3 and Comparative Examples 1 to 5 are summarized in Table 2 below.

TABLE 2

| | Laser power (W) | | | Number of units of lines drawn with different energy | Stepwise energy adjustment of each laser drawn line (starting point < end point) |
|---|---|---|---|---|---|
| | $1^{st}$ line | $2^{nd}$ line | $3^{rd}$ line | | |
| Example 1 | 19.3 | 17.0 | 18.0 | 2 | No |
| Example 2 | 19.3 | 17.0 | 18.0 | 2 | Yes |
| Example 3 | 19.3 | 18.0 | 17.0 | 2 | Yes |

TABLE 2-continued

| | Laser power (W) | | | Number of units of lines drawn with different energy | Stepwise energy adjustment of each laser drawn line (starting point < end point) |
|---|---|---|---|---|---|
| | $1^{st}$ line | $2^{nd}$ line | $3^{rd}$ line | | |
| Comparative Example 1 | 19.3 | 17.0 | 17.0 | 1 | Yes |
| Comparative Example 2 | 17.0 | 17.0 | 17.0 | 0 | Yes |
| Comparative Example 3 | 19.3 | 19.3 | 19.3 | 0 | Yes |
| Comparative Example 4 | 19.3 | 17.0 | 17.0 | 1 | No |
| Comparative Example 5 | 19.3 | 17.0 | 17.0 | 1 | Yes |

TABLE 3-1

| | Modulation value | | Decodability value | |
|---|---|---|---|---|
| Example 1 | 59 | C | 44 | C |
| Example 2 | 59 | C | 43 | C |
| Example 3 | 61 | B | 40 | C |
| Comparative Example 1 | 60 | B | 28 | D |
| Comparative Example 2 | 47 | D | 41 | C |
| Comparative Example 3 | 59 | C | 56 | B |
| Comparative Example 4 | 60 | B | 32 | D |
| Comparative Example 5 | 58 | C | 20 | F |

TABLE 3-2

| | Image evaluation | Repetition durability | |
|---|---|---|---|
| | | Number of times | Evaluation |
| Example 1 | A | 500 | B |
| Example 2 | A | 1,000 | A |
| Example 3 | A | 700 | B |
| Comparative Example 1 | F | 1,400 | A |
| Comparative Example 2 | F | 2,000 | A |
| Comparative Example 3 | A | 300 | F |
| Comparative Example 4 | F | 600 | B |
| Comparative Example 5 | F | 2,000 | A |

Example 4

A bar code was drawn in the same manner as Example 1 except that the object to be drawn in Example 1 was changed to a bar code described in Table 4 below (CODE128) and that the drawing conditions were changed to those described in Table 5. That is, the laser light was scanned as illustrated in FIG. 4 with the drawing pitch of laser drawn lines adjacent to each other of 0.125 mm; the laser power of the first line was 19.3 W, the laser power of the second and the fourth lines was 17.0 W, and the laser power of the third and the fifth lines was 18.0 W. An image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 500 repetitions. Here, erasing traces of the image became noticeable after 600 times, and uniform erasing was no longer possible. Results of the image evaluation and the repetition durability test are shown in Table 6-2.

TABLE 4

| Bar code type | Drawing content | Bar code height | Number of lines of narrow bars | Number of lines of wide bars |
|---|---|---|---|---|
| CODE128 | 12345 | 8 mm | 1 | 3/4/5 |

*The bar code (CODE 128) is composed of bars, namely a narrow bar and wide bars, with thicknesses varied in four stages, and it is applied to the wide bars in Examples and Comparative Examples. The wide bars are composed of 3, 4 or 5 lines. When a wide bar composed of 3 lines, which is fewer than 5 lines, is drawn, a control method from the $1^{st}$ line to the $3^{rd}$ line in Table 5 is applied, and the $4^{th}$ line and the $5^{th}$ line are not drawn. Similarly, a wide bar composed of 4 lines, which is fewer than 5 lines, is drawn, a control method from the $1^{st}$ line to the $4^{th}$ line in Table 5 is applied, and the $5^{th}$ line is not drawn.

Example 5

A bar code was drawn in the same manner as Example 4 except that each of the second and subsequent laser drawn lines in Example 4 was divided into 10 segments from a starting point to an end point and that the scanning speed was decremented in a stepwise manner with the scanning speed at the starting point of 4,200 mm/s, the scanning speed at the end point of 3,000 mm/s and the decrement of 120 mm/s so that the irradiation energy increased in a stepwise manner from the starting point to the end point, and an image quality of the bar code was evaluated in the same manner as Example 1. Here, the irradiation energy of the first laser drawn line was uniform. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 1,000 times. However, erasing traces of the image became noticeable after 1,100 times, and uniform erasing was no longer possible. Results of the image evaluation and the repetition durability test are shown in Table 6-2.

Example 6

A bar code was drawn in the same manner as Example 5 except that the laser power the fifth line in Example 5 was changed to 17.0 W, and an image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 1,100 times. However, erasing traces of the image became noticeable after 1,200 times, and uniform erasing was no longer possible. Results of the image evaluation and the repetition durability test are shown in Table 6-2.

Example 7

A bar code was drawn in the same manner as Example 5 except that the laser power of the fourth line in Example 5 was changed to 18.0 W, and an image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 900 times. However, erasing traces of the image became noticeable after 1,000 times, and uniform erasing was no longer possible. Results of the image evaluation and the repetition durability test are shown in Table 6-2.

Example 8

A bar code was drawn in the same manner as Example 5 except that the laser power of the second and the fourth lines in Example 5 was changed to 18.0 W, respectively, and the laser power of the third and the fifth lines were changed to 17.0 W, respectively, and an image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 700 times. However, erasing traces of the image became noticeable after 800 times, and uniform erasing was no longer possible. Results of the image evaluation and the repetition durability test are shown in Table 6-2.

Comparative Example 6

A bar code was drawn in the same manner as Example 5 except that the laser power of the third and the fifth lines in Example 5 was changed to 17.0 W, respectively, and an image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 1,400 times. However, erasing traces of the image became noticeable after 1,500 times, and uniform erasing was no longer possible. Results of the image evaluation and the repetition durability test are shown in Table 6-2.

Comparative Example 7

A bar code was drawn in the same manner as Example 5 except that the laser power of the first, the third and the fifth lines in Example 5 was changed to 17.0 W, respectively, and an image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible even after 2,000 repetitions. Results of the image evaluation and the repetition durability test are shown in Table 6-2.

Comparative Example 8

A bar code was drawn in the same manner as Example 5 except that the laser power of the second to the fifth lines in Example 5 was changed to 19.3 W, respectively, and an image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 300 times. However, erasing traces of the image became noticeable after 400 times, and uniform erasing was no longer possible. Results of the image evaluation and the repetition durability test are shown in Table 6-2.

Comparative Example 9

A bar code was drawn in the same manner as Example 4 except that the laser power of the third and the fifth lines in Example 4 was changed to 17.0 W, respectively, and an image quality of the bar code was evaluated in the same manner as Example 1. Results are shown in Table 6-1.

Also, image erasing was carried out in the same manner as Example 1, and it was possible to erase the image completely.

Image recording and image erasing were repeated under the above conditions, and the medium was visually observed. Uniform image recording and erasing were possible up to 600 times. However, erasing traces of the image became noticeable after 700 times, and uniform erasing was no longer possible. Results of the image evaluation and the repetition durability test are shown in Table 6-2.

Comparative Example 10

A bar code was drawn in the same manner as Example 5 except that the laser power of the third and the fifth lines in Example 5 was changed to 17.0 W, respectively, and that the amount of tilt from the starting point to the end point of the second and the fourth lines was set to 0.056 mm as illustrated in FIG. 3, and an image quality of the bar code was evaluated in the same manner as Example 1. Comparative Example 10 is a reproduction of a laser scanning method described in JP-A No. 2011-116116. Results are shown in Table 6-1.

Here, the amount of tilt is defined as a shortest distance between a central point of the second laser drawn line 222 in a length direction thereof and a line drawn from the second starting point in parallel with the first laser drawn line 221 in FIG. 3.

Also, image erasing was carried out in the same manner as Example 1, and it was possible to erase the image completely.

Image recording and image erasing were repeated under the above conditions, and the medium was visually observed. Uniform image recording and erasing were possible even after 2,000 repetitions. Results of the image evaluation and the repetition durability test are shown in Table 6-2.

Next, laser recording conditions of Examples 4 to 8 and Comparative Examples 6 to 10 are summarized in Table 5 below.

TABLE 5

| | Laser power (W) | | | | | Number of unit of lines drawn with | Stepwise energy adjustment of each laser drawn line with starting |
|---|---|---|---|---|---|---|---|
| | 1st Line | 2nd Line | 3rd Line | 4th Line | 5th Line | different energy | point < end point |
| Example 4 | 19.3 | 17.0 | 18.0 | 17.0 | 18.0 | 4 | No |
| Example 5 | 19.3 | 17.0 | 18.0 | 17.0 | 18.0 | 4 | Yes |
| Example 6 | 19.3 | 17.0 | 18.0 | 17.0 | 17.0 | 3 | Yes |
| Example 7 | 19.3 | 17.0 | 18.0 | 18.0 | 18.0 | 2 | Yes |
| Example 8 | 19.3 | 18.0 | 17.0 | 18.0 | 17.0 | 4 | Yes |
| Comparative Example 6 | 19.3 | 17.0 | 17.0 | 17.0 | 17.0 | 1 | Yes |
| Comparative Example 7 | 17.0 | 17.0 | 17.0 | 17.0 | 17.0 | 0 | Yes |
| Comparative Example 8 | 19.3 | 19.3 | 19.3 | 19.3 | 19.3 | 0 | Yes |
| Comparative Example 9 | 19.3 | 17.0 | 17.0 | 17.0 | 17.0 | 1 | No |
| Comparative Example 10 | 19.3 | 17.0 | 17.0 | 17.0 | 17.0 | 1 | Yes |

TABLE 6-1

| | Modulation value | | Decodability value | |
|---|---|---|---|---|
| Example 4 | 59 | C | 44 | C |
| Example 5 | 59 | C | 43 | C |
| Example 6 | 60 | B | 43 | C |
| Example 7 | 59 | C | 46 | C |
| Example 8 | 61 | B | 40 | C |
| Comparative Example 6 | 60 | B | 28 | D |
| Comparative Example 7 | 47 | D | 41 | C |
| Comparative Example 8 | 59 | C | 56 | B |
| Comparative Example 9 | 60 | B | 32 | D |
| Comparative Example 10 | 58 | C | 20 | F |

TABLE 6-2

| | Image evaluation | Repetition durability | |
|---|---|---|---|
| | | Number of times | Evaluation |
| Example 4 | A | 500 | B |
| Example 5 | A | 1000 | A |
| Example 6 | A | 1100 | A |
| Example 7 | A | 900 | B |
| Example 8 | A | 700 | B |
| Comparative Example 6 | F | 1400 | A |
| Comparative Example 7 | F | 2000 | A |
| Comparative Example 8 | A | 300 | F |
| Comparative Example 9 | F | 600 | B |

TABLE 6-2-continued

| | Image evaluation | Repetition durability | |
|---|---|---|---|
| | | Number of times | Evaluation |
| Comparative Example 10 | F | 2000 | A |

Example 11

Image Recording Step

A laser diode BMU25-975-01-R, manufactured by Oclaro Inc. (center wavelength: 976 nm), was used for the prepared thermoreversible recording medium of Production Example 1, and it was adjusted such that a laser power was 19.3 W, an irradiation distance as 175 mm, a spot diameter was about 0.50 mm, a line width was 0.25 mm and a scanning speed was 3,000 mm/s.

Figure 2:
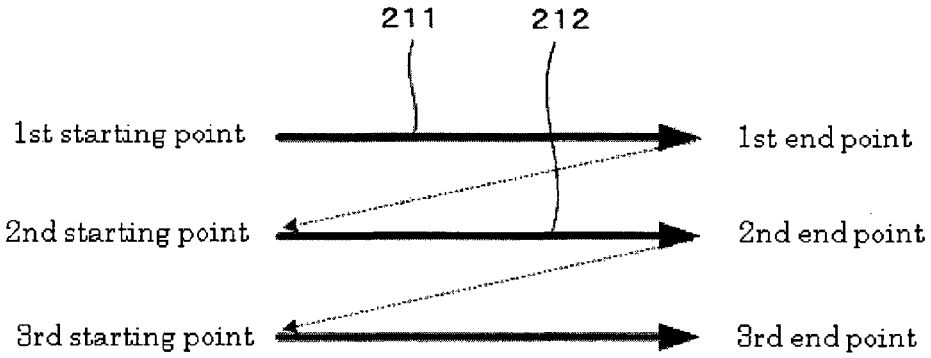
FIG. 2 is a schematic diagram illustrating another example of image recording by a conventional image processing method.

A laser light was scanned as illustrated in FIG. 2 with a drawing pitch of laser drawn lines adjacent to each other of 0.125 mm, a laser power of a first line of 19.3 W, a laser power of a second line of 17.0 W and a laser power of a third line of 18.0 W.

Under the above image recording conditions, an image filled by five (5) lines was drawn. The image was visually observed, and the image was formed with a uniform density and an appropriate line width.

—Image Erasing Step—

Next, adjustments were made so that the laser power was 20 W, the irradiation distance was 130 mm, the spot diameter was about 3 mm, and the scanning speed was 650 mm/s. Then, it was irradiated by 20 scans so that the resulting drawing pitch was 0.6 mm, and the image was completely erasable.

Image recording and image erasing were repeated under the above conditions, and the medium was visually observed. Uniform image recording and erasing were possible up to 1,100 repetitions. Here, erasing traces of the image became noticeable after 1,200 times, and uniform erasing was no longer possible.

Image evaluation, an evaluation method of the repetition durability test, and the evaluation criteria are described below. Results are shown in Table 7.

[Image Evaluation]

A: It was visually observed that the recorded image was formed with a uniform density and an appropriate line width.

F: It was visually observed that the recorded image was not formed with a uniform density and an appropriate line width.

[Evaluation Criteria of Repetition Durability Test]

A: Uniform image recording and erasing were possible even when the repetition of image recording and image erasing was 1,000 times or greater.

B: Uniform image recording and erasing were possible when the repetition of image recording and image erasing was 500 times to 999 times.

F: Uniform image recording and erasing were possible when the repetition of image recording and image erasing was less than 500 times.

Example 12

An image evaluation was carried out in the same manner as Example 11 except that the drawing pitch of laser drawn lines adjacent to each other in Example 11 was changed to 0.190 mm, and the image was formed with a uniform density and an appropriate line width.

Also, image erasing was carried out in the same manner as Example 11, and the image was completely erasable.

Image recording and image erasing were repeated under the above conditions, and the medium was visually observed. Uniform image recording and erasing were possible even after 2,000 repetitions. Results of the image evaluation and the repetition durability test are shown in Table 7.

Reference Example 1

An image evaluation was carried out in the same manner as Example 11 except that the drawing pitch of laser drawn lines adjacent to each other in Example 11 was changed to 0.080 mm, and the image was formed with a uniform density and an appropriate line width.

Also, image erasing was carried out in the same manner as Example 11, and the image was completely erasable.

Image recording and image erasing were repeated under the above conditions, and the medium was visually observed. Uniform image recording and erasing were possible up to 100 repetitions. However, erasing traces of the image became noticeable after 200 times, and uniform erasing was no longer possible. Results of the image evaluation and the repetition durability test are shown in Table 7.

Reference Example 2

An image evaluation was carried out in the same manner as Example 11 except that the drawing pitch of laser drawn lines adjacent to each other in Example 11 was changed to 0.240 mm. The recorded image had printing voids at overlapping portions of the drawn lines, and the image was not formed with a uniform density.

Also, image erasing was carried out in the same manner as Example 11, and the image was completely erasable.

Image recording and image erasing were repeated under the above conditions, and the medium was visually observed. Uniform image recording and erasing were possible even after 2,000 repetitions. Results of the image evaluation and the repetition durability test are shown in Table 7.

TABLE 7

| | Image evaluation | Repetition durability | |
|---|---|---|---|
| | | Number of times | Number of times |
| Example 11 | A | 1,100 | A |
| Example 12 | A | 2,000 | A |
| Reference Example 1 | A | 100 | F |
| Reference Example 2 | F | 2,000 | A |

Aspects of the present invention are as follows.

<1> An image processing method, including:

image recording, wherein an image composed of a plurality of laser drawn lines is recorded by heating by irradiating parallel laser lights on a recording medium spaced by a predetermined distance, wherein, in the image recording, among the plurality of laser drawn lines constituting the image, at least two units of lines drawn with different energy, each composed of a pair of laser drawn lines adjacent to each other and with different irradiation energy, are formed.

<2> The image processing method according to <1>, wherein, among the plurality of laser drawn lines constituting the image, laser drawn lines excluding a laser drawn line irradiated first have irradiation energy such that the irradiation energy at a line end point is set to be incremented in a stepwise manner from the irradiation energy at a line starting point.

<3> The image processing method according to <1> or <2>, wherein, among the plurality of laser drawn lines constituting the image, in order of laser light irradiation, even-numbered drawn lines have irradiation energy smaller than odd-numbered drawn lines adjacent to the even-numbered drawn lines.

<4> The image processing method according to any one of <1> to <3>, wherein, among the plurality of laser drawn lines constituting the image, the laser drawn line irradiated first has largest irradiation energy.

<5> The image processing method according to any one of <2> to <4>, wherein a segment between the line starting point and the line end point of each of the laser drawn lines is divided into a plurality of unit line segments, and the irradiation energy is incremented in a stepwise manner at each of the unit line segments from the line starting point to the line end point.

<6> The image processing method according to any one of <1> to <5>, wherein the irradiation energy of the laser drawn line is adjusted by an irradiation power of the laser light.

<7> The image processing method according to any one of <1> to <5>, wherein the irradiation energy of the laser drawn line is adjusted by a scanning speed of the laser light.

<8> The image processing method according to any one of <1> to <7>, wherein the laser light is a YAG laser light, a fiber laser light or a laser diode light, or any combination thereof.

<9> The image processing method according to any one of <1> to <8>, wherein the recording medium is a thermoreversible recording medium, wherein the thermoreversible recording medium includes:

a substrate; and a thermoreversible recording layer on the substrate, wherein the thermoreversible recording layer includes: a photothermal conversion material which absorbs a light of a specific wavelength and converts the light into heat; a leuco dye; and a reversible color developing agent, wherein the thermoreversible recording layer reversibly changes a color tone thereof depending on a temperature.

<10> An image processing apparatus, including:

a laser light emitting unit; and a laser light scanning unit which scans a laser light on a laser light irradiation surface of the recording medium, wherein the image processing apparatus is used for the image processing method according to any one of <1> to <9>, The image processing method of the present invention and the image processing apparatus may be widely used for: input-output tickets; stickers for frozen-food containers, industrial products, various chemical containers and so on; and large screens and various displays for logistics management applications and manufacturing process management applications, and they are especially suitable for use in logistics and delivery systems and process management systems in factories.

REFERENCE SIGNS LIST

1 Laser oscillator

2 Beam expander

3 Mask or aspherical lens
4 Galvanometer
4A Mirror
5 Scanning unit
6 fθ lens
7 Thermoreversible recording medium
100 Thermoreversible recording medium
101 Substrate
102 Thermoreversible recording layer
103 First thermoreversible recording layer
104 Photothermal conversion layer
105 Second thermoreversible recording layer
106 First oxygen barrier layer
107 Second oxygen barrier layer
108 Ultraviolet absorbing layer

The invention claimed is:

1. An image processing method, comprising:

image recording, wherein an image composed of a plurality of laser drawn lines is recorded by heating by irradiating parallel laser lights on a thermoreversible recording medium spaced by a predetermined distance, wherein, in the image recording, among the plurality of laser drawn lines constituting the image, at least two units of lines drawn with different energy, each composed of a pair of laser drawn lines adjacent to each other and with different irradiation energy, are formed, and wherein, among the plurality of laser drawn lines constituting the image, in order of laser light irradiation, even-numbered drawn lines are recorded employing irradiation energy smaller than that employed to record odd-numbered drawn lines adjacent to the even-numbered drawn lines.

2. The image processing method according to claim 1, wherein, among the plurality of laser drawn lines constituting the image, laser drawn lines excluding a laser drawn line irradiated first have irradiation energy such that the irradiation energy at a line end point is set to be incremented in a stepwise manner from the irradiation energy at a line starting point.

3. The image processing method according to claim 2, wherein a segment between the line starting point and the line end point of each of the laser drawn lines is divided into a plurality of unit line segments, and the irradiation energy is incremented in a stepwise manner at each of the unit line segments from the line starting point to the line end point.

4. The image processing method according to claim 1, wherein, among the plurality of laser drawn lines constituting the image, the laser drawn line irradiated first has largest irradiation energy.

5. The image processing method according to claim 1, wherein the irradiation energy of the laser drawn line is adjusted by an irradiation power of the laser light.

6. The image processing method according to claim 1, wherein the irradiation energy of the laser drawn line is adjusted by a scanning speed of the laser light.

7. The image processing method according to claim 1, wherein the laser light is a YAG laser light, a fiber laser light or a laser diode light, or any combination thereof.

8. The image processing method according to claim 1, wherein the thermoreversible recording medium comprises:

a substrate; and a thermoreversible recording layer on the substrate, wherein the thermoreversible recording layer comprises: a photothermal conversion material which absorbs a light of a specific wavelength and converts the light into heat; a leuco dye; and a reversible color developing agent, wherein the thermoreversible recording layer reversibly changes a color tone thereof depending on a temperature.

9. An image processing apparatus, comprising:

a laser light emitting unit; and a laser light scanning unit which scans a laser light on a laser light irradiation surface of a thermoreversible recording medium, wherein the image processing apparatus is configured to perform an image processing method comprising:

image recording, wherein an image composed of a plurality of laser drawn lines is recorded by heating by irradiating parallel laser lights on the thermoreversible recording medium spaced by a predetermined distance, and wherein, in the image recording, among the plurality of laser drawn lines constituting the image, at least two units of lines drawn with different energy, each composed of a pair of laser drawn lines adjacent to each other and with different irradiation energy, are formed, and wherein, among the plurality of laser drawn lines constituting the image, in order of laser light irradiation, even-numbered drawn lines are recorded employing irradiation energy smaller than that employed to record odd-numbered drawn lines adjacent to the even-numbered drawn lines.

* * * * *